US006923531B2

(12) United States Patent
Saruta

(10) Patent No.: US 6,923,531 B2
(45) **Date of Patent: *Aug. 2, 2005**

(54) INK CARTRIDGE WITH MEMORY

(75) Inventor: Toshihisa Saruta, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/286,807

(22) Filed: Nov. 4, 2002

(65) Prior Publication Data

US 2003/0058297 A1 Mar. 27, 2003

Related U.S. Application Data

(60) Continuation of application No. 10/060,251, filed on Feb. 1, 2002, now abandoned, which is a division of application No. 09/449,730, filed on Nov. 26, 1999, now Pat. No. 6,371,586.

(30) Foreign Application Priority Data

| | | |
|---|---|---|
| Nov. 26, 1998 | (JP) | 10-336330 |
| Nov. 26, 1998 | (JP) | 10-336331 |
| Dec. 24, 1998 | (JP) | 10-367490 |
| Jan. 11, 1999 | (JP) | 11-3993 |
| Aug. 26, 1999 | (JP) | 11-239915 |
| Oct. 18, 1999 | (JP) | 11-296024 |
| Nov. 25, 1999 | (JP) | 11-334016 |

(51) Int. Cl.[7] ..... B41J 2/175
(52) U.S. Cl. ..... 347/86; 347/7; 347/19
(58) Field of Search ..... 347/7, 19, 86

(56) References Cited

U.S. PATENT DOCUMENTS

| | | | |
|---|---|---|---|
| 4,961,088 | A | 10/1990 | Gilliland et al. |
| 5,049,898 | A | 9/1991 | Arthur et al. |
| 5,365,312 | A | 11/1994 | Hillman et al. |
| 5,410,641 | A | 4/1995 | Wakabayashi et al. |
| 5,506,611 | A | 4/1996 | Ujita et al. |

(Continued)

FOREIGN PATENT DOCUMENTS

| | | |
|---|---|---|
| EP | 0443245 | 8/1991 |
| EP | 0854043 | 7/1998 |
| EP | 0854044 | 7/1998 |
| EP | 0873873 | 10/1998 |
| EP | 0891865 | 1/1999 |

(Continued)

OTHER PUBLICATIONS

U.S. Appl. No. 09/432,272, filed Nov. 2, 1999, Saruta.
U.S. Appl. No. 10/465,650, filed Jun. 20, 2003, Saruta.

(Continued)

*Primary Examiner*—Huan Tran
(74) *Attorney, Agent, or Firm*—Stroock & Stroock & Lavan LLP

(57) ABSTRACT

In a printer of the present invention, an EEPROM that carries out sequential access and has a small storage capacity is applied for storage elements mounted on both black and color ink cartridges. Data relating to each ink cartridge, for example, data on remaining quantities of respective inks in the ink cartridge, are stored as 8-bit data in the storage element of the ink cartridge. A print controller incorporated in the printer has an EEPROM, in which the data relating to the ink cartridges are stored as 32-bit data. In the case of no replacement of the ink cartridge, the 32-bit data are used for the subsequent processing. In the case of replacement of one ink cartridge with another, on the other hand, the 8-bit data are used for the subsequent processing. This arrangement of the invention enables the data relating to the ink cartridges, for example, the data on the remaining quantities of the respective inks in the ink cartridges, to be processed accurately even when a storage unit of a small storage capacity is applied for the storage elements mounted on the ink cartridges.

12 Claims, 20 Drawing Sheets

U.S. PATENT DOCUMENTS

| | | | | |
|---|---|---|---|---|
| 5,519,418 | A | 5/1996 | Nishikawa et al. | |
| 5,610,635 | A | 3/1997 | Murray et al. | |
| 5,646,660 | A | 7/1997 | Murray | |
| 5,699,091 | A | 12/1997 | Bullock et al. | |
| 5,786,828 | A | 7/1998 | Yamamoto | |
| 5,788,388 | A | 8/1998 | Cowger et al. | |
| 5,812,156 | A | 9/1998 | Bullock et al. | |
| 5,835,817 | A | 11/1998 | Bullock et al. | |
| 5,861,897 | A | 1/1999 | Ide et al. | |
| 5,930,553 | A | 7/1999 | Hirst et al. | |
| RE36,279 | E | 8/1999 | Ujita | |
| 5,975,677 | A | 11/1999 | Marler et al. | |
| 6,019,449 | A | 2/2000 | Bullock et al. | |
| 6,019,461 | A | 2/2000 | Yoshimura et al. | |
| 6,065,824 | A | 5/2000 | Bullock et al. | |
| 6,109,723 | A | 8/2000 | Castle et al. | |
| 6,126,265 | A | 10/2000 | Childers et al. | |
| 6,196,670 | B1 * | 3/2001 | Saruta | 347/86 |
| 6,312,073 | B1 | 11/2001 | Inora et al. | |
| 6,371,586 | B1 * | 4/2002 | Saruta | 347/7 |
| 6,447,090 | B1 | 9/2002 | Saruta | |
| 6,494,559 | B1 | 12/2002 | Tsuji | |
| 6,565,198 | B2 | 5/2003 | Saruta et al. | |
| 6,631,967 | B1 | 10/2003 | Saruta | |
| 2002/0085051 | A1 | 7/2002 | Saruta | |
| 2002/0180851 | A1 | 12/2002 | Saruta | |
| 2002/0191038 | A1 | 12/2002 | Tsuji | |
| 2002/0196302 | A1 | 12/2002 | Saruta | |
| 2003/0007027 | A1 | 1/2003 | Saruta | |
| 2003/0197751 | A1 | 10/2003 | Saruta | |
| 2004/0095407 | A1 * | 5/2004 | Sarula | 347/19 |

FOREIGN PATENT DOCUMENTS

| | | | |
|---|---|---|---|
| EP | 0940259 | A2 | 9/1999 |
| EP | 1004449 | A2 | 5/2000 |
| EP | 1004451 | A2 | 5/2000 |
| EP | 1066967 | A2 | 1/2001 |
| EP | 1080911 | A2 | 3/2001 |
| EP | 1080912 | A2 | 3/2001 |
| EP | 1114726 | A1 | 7/2001 |
| EP | 1136268 | A1 | 9/2001 |
| EP | 1247651 | A2 | 10/2002 |
| GB | 2350220 | A | 11/2000 |
| JP | 62-184856 | | 8/1987 |
| JP | 2-279344 | | 11/1990 |
| JP | 4-500482 | | 1/1992 |
| JP | 05-020275 | | 1/1993 |
| JP | 05-193127 | | 8/1993 |
| JP | 06-126981 | | 5/1994 |
| JP | 8-187854 | | 7/1996 |
| JP | 8-197748 | | 8/1996 |
| JP | 8-224885 | | 9/1996 |
| JP | 08-310007 | | 11/1996 |
| JP | 9-1823 | | 1/1997 |
| JP | 9-74539 | A | 3/1997 |
| JP | 9-314861 | | 12/1997 |
| JP | 10-217509 | | 8/1998 |
| JP | 2000-301738 | | 10/2000 |
| WO | WO90/00974 | | 2/1990 |
| WO | WO96/05061 | | 2/1996 |
| WO | WO98/52762 | | 11/1998 |
| WO | WO99/65695 | | 12/1999 |
| WO | WO00/26034 | | 5/2000 |

OTHER PUBLICATIONS

Japanese Office Action mailed Sep. 16, 2003, for Application Ser. No. 2002–152154.

Japanese Office Action mailed Sep. 16, 2003, for Application Ser. No. 2002–179601.

Japanese Office Action mailed Oct. 28, 2003, for Application Ser. No. 2002–152146.

Japanese Office Action mailed Oct. 28, 2003, for Application Ser. No. 2002–171460.

* cited by examiner

*Fig. 8*

80, 107K

| | Contents of Information | |
|---|---|---|
| 700 | Frequency of attachment (initial value =0) | 760 |
| 701 | 1st Data on remaining quantity of black ink (8 bits) | |
| 702 | 2nd Data on remaining quantity of black ink (8 bits) | |
| 711 | Data on time (year) of unsealing ink cartridge | 750 |
| 712 | Data on time (month) of unsealing ink cartridge | |
| 713 | Version data of ink cartridge | |
| 714 | Data on type of ink | |
| 715 | Data on year of manufacture | |
| 716 | Data on month of manufacture | |
| 717 | Data on date of manufacture | |
| 718 | Data on production line | |
| 719 | Serial number data | |
| 720 | Data on recycle | |

*Fig. 9*

80, 107F

| | Contents of Information | |
|---|---|---|
| 600 | Frequency of attachment (initial value =0) | 660 |
| 601 | 1st Data on remaining quantity of cyan ink (8 bits) | |
| 602 | 2nd Data on remaining quantity of cyan ink (8 bits) | |
| 603 | 1st Data on remaining quantity of magenta ink (8 bits) | |
| 604 | 2nd Data on remaining quantity of magenta ink (8 bits) | |
| 605 | 1st Data on remaining quantity of yellow ink (8 bits) | |
| 606 | 2nd Data on remaining quantity of yellow ink (8 bits) | |
| 607 | 1st Data on remaining quantity of light cyan ink (8 bits) | |
| 608 | 2nd Data on remaining quantity of light cyan ink (8 bits) | |
| 609 | 1st Data on remaining quantity of light magenta ink (8 bits) | |
| 610 | 2nd Data on remaining quantity of light magenta ink (8 bits) | |
| 611 | Data on time (year) of unsealing ink cartridge | 650 |
| 612 | Data on time (month) of unsealing ink cartridge | |
| 613 | Version data of ink cartridge | |
| 614 | Data on type of ink | |
| 615 | Data on year of manufacture | |
| 616 | Data on month of manufacture | |
| 617 | Data on date of manufacture | |
| 618 | Data on production line | |
| 619 | Serial number data | |
| 620 | Data on recycle | |

*Fig. 10*

90

| | Contents of Information |
|---|---|
| 801 | Data on remaining quantity of black ink (32 bits) |
| 802 | Data on time (year) of unsealing ink cartridge |
| 803 | Data on time (month) of unsealing ink cartridge |
| 804 | Version data of ink cartridge |
| 805 | Data on type of ink |
| 806 | Data on year of manufacture |
| 807 | Data on month of manufacture |
| 808 | Data on date of manufacture |
| 809 | Data on production line |
| 810 | Serial number data |
| 811 | Data on recycle |
| 821 | Data on remaining quantity of cyan ink (32 bits) |
| 822 | Data on remaining quantity of magenta ink (32 bits) |
| 823 | Data on remaining quantity of yellow ink (32 bits) |
| 824 | Data on remaining quantity of light cyan ink (32 bits) |
| 825 | Data on remaining quantity of light magenta ink (32 bits) |
| 826 | Data on time (year) of unsealing ink cartridge |
| 827 | Data on time (month) of unsealing ink cartridge |
| 828 | Version data of ink cartridge |
| 829 | Data on type of ink |
| 830 | Data on year of manufacture |
| 831 | Data on month of manufacture |
| 832 | Data on date of manufacture |
| 833 | Data on production line |
| 834 | Serial number data |
| 835 | Data on recycle |

*Fig. 19*

| SERIAL NUMBER | TOTAL AMOUNT OF INK CONSUMPTION Iha |
|---|---|
| A12 | I t t 1 |
| B56 | I t t 2 |
| C13 | I t t 3 |
| A23 | I t t 4 |
| ⋮ | ⋮ |

INK CARTRIDGE WITH MEMORY

This application is a Continuation of application Ser. No. 10/060,251 filed on Feb. 1, 2002 now abandond, which is a DIV of Ser. No. 09/449,730 filed Nov. 26, 1999 now U.S. Pat. No. 6,371,586.

BACKGROUND OF THE INVENTION

1. Field of the Invention

The present invention relates to a printing apparatus, such as an ink jet printer and an ink jet plotter, and also to an ink cartridge detachably attached to a printer main body of the printing apparatus. More specifically the invention pertains to a technique of processing and storing required pieces of information in the ink cartridge.

2. Description of the Related Art

The printing apparatus like the ink jet printer and the ink jet plotter mainly includes an ink cartridge, in which one or plural inks are kept, and a printer main body with a print head to carry out actual printing operations on a printing medium. The print head ejects ink fed from the ink cartridge onto the printing medium, such as printing paper, so as to implement printing on the printing medium. The ink cartridge is designed to be detachably attached to the printer main body. A new ink cartridge has a predetermined quantity of ink kept therein. When the ink kept in an ink cartridge runs out, the ink cartridge is replaced with a new one. Such a printing apparatus is arranged to cause the printer main body to calculate the remaining quantity of ink in the ink cartridge based on the amount of ink transferred from the print head and to inform the user of a state of running out of the ink, in order to prevent the printing procedure from being interrupted by the out-of-ink.

The data on the remaining quantities of inks are generally stored only in the printer main body or in a printer driver that controls the printer. In the event that a first ink cartridge is replaced with a second ink cartridge in the course of the printing operation, the information relating to the first ink cartridge, such as the data on the remaining quantities of inks, are thus lost or made wrong.

One proposed technique to solve this problem utilizes a non-volatile memory provided in the ink cartridge and causes the required data, for example, the data on the remaining quantities of inks, to be written from the printer main body into the non-volatile memory (for example, JAPANESE PATENT LAID-OPEN GAZETTE No. 62-184856). In the case of replacement of the ink cartridge during the printing operation, this technique ensures the storage of the data on the remaining quantities of inks.

The data on the remaining quantities of inks is required to have a relatively high accuracy, in order to inform the user of the precise timing of replacement of the ink cartridge. Storage of such data with a high accuracy in the ink cartridge makes the required storage capacity undesirably large. In the case where the data on the remaining quantities of inks has only a low accuracy, on the other hand, the timing of an alarm of the ink end state, in which a certain ink in the ink cartridge is running out, may significantly be contradictory to the actual remaining quantity of ink. In a structure that updates the data on the remaining quantities of inks at a power-off time, the printer main body reads the data on the remaining quantity of each ink from the ink cartridge at every start of power supply and interprets the read-out data as a value of the lower limit within the preset accuracy. By way of example, it is assumed that the data stored in the ink cartridge expresses the remaining quantity of each ink as a value of percentage in the range of 0 to 100% and has a length of 1 byte (8 bits) and an accuracy of 1%. When the data read from the ink cartridge is '50', the printer main body can not specify the exact value of the data. The data '50' may be obtained by rounding 50.9 or 50.1. In order to prepare for the worst, the printer main body deals with the data '50' as a value of the lower limit '50.0'.

In this structure, even in the case where only a little quantity of ink is used, data should be reduced by 1%. This means that repeating such use 100 times causes the data on the remaining quantity of ink in the ink cartridge to be equal to 0, although there is still a sufficient quantity of ink remaining in the ink cartridge. In another structure that does not reduce data by 1% in the case of use of a little quantity of ink, repeating such use many times causes an alarm of the ink end state not to be given even if the actual remaining quantity of ink is equal to zero. In an ink cartridge with a memory or a printer using such an ink cartridge, the storage capacity of several bytes for each ink is required to monitor the remaining quantity of ink precisely. In the case of a color ink cartridge that keeps a plurality of different color inks in a casing thereof, a certain storage capacity should be allocated to each color ink. For example, in the case of a color ink cartridge including five color inks, if the required storage capacity for each color ink is 4 bytes, the total storage capacity is as large as 5×4=20 bytes (20×8=160 bits).

Increasing the data length to be written makes it difficult to write all the required data within a short time period after a power-off operation. When a power switch mounted on a switch panel of the printer is operated, the applicable sequence enables the printer to confirm conclusion of the writing operation of data into the memory of the ink cartridge, before actually turning the power source off. In the case where the power supply is forcibly cut off on the side of the power line by pulling the power plug out of the socket or turning off the power of an extension connected to a computer, however, the writing operation of data into the memory of the ink cartridge should be completed within a very short time period. If the power voltage is lost in the course of the writing operation, the reliability of data in the ink cartridge is significantly lowered. This prevents the ink cartridge from being used adequately. The use of the memory having a large storage capacity undesirably increases the manufacturing cost of expendable ink cartridges. This is also undesirable from the viewpoint of resource saving.

The problems discussed above arise in any printing apparatus that does not directly measure the remaining quantity of ink or the amount of ink consumption in an ink cartridge but causes the printer to compute such data, and in an ink cartridge attached thereto. Such printing apparatus includes an ink jet-type printing apparatus that uses ink obtained by mixing or dissolving a pigment or a dye with or in a solvent and ejects ink droplets in the liquid state to implement printing, a printing apparatus that uses an ink cartridge with an ink toner accommodated therein, and a thermal transfer-type printing apparatus.

SUMMARY OF THE INVENTION

The object of the present invention is thus to provide a technique that is applicable to a printer and a cartridge attached thereto and enables information relating to the cartridge, such as pieces of information on remaining quantities of inks, to be adequately processed, while not increasing the manufacturing cost of the cartridge.

At least part of the above and the other related objects is actualized by a printer, to which a cartridge is detachably attached, wherein the cartridge keeps ink therein and has a rewritable non-volatile memory. The printer causes the ink kept in the cartridge to be transferred from a print head mounted on the printer to a printing medium, thereby implementing a printing operation. The printer includes: a rewritable printer memory; an information writing unit that writes information on a quantity of ink in the cartridge, which is consumed with a progress of a printing operation on the printing medium, as data of a predetermined number of bits, into the printer memory; and a memory writing unit that converts the information on the quantity of ink in the cartridge to data of a specific number of bits, which is less than the predetermined number of bits, and writes the converted data of the specific number of bits into the non-volatile memory included in the cartridge.

The printer of the present invention writes the information on the quantity of ink in the cartridge, which is consumed with a progress of a printing operation on the printing medium, as data of a predetermined number of bits into the printer memory and as converted data of a specific number of bits, which is less than the predetermined number of bits, into the non-volatile memory of the cartridge. This arrangement effectively prevents an undesirable increase of the storage capacity, while enabling this information on the quantity of ink to be stored in a non-volatile manner in the cartridge.

The technique applicable to reduce the number of bits may omit lower bits from the data of the predetermined number of bits written in the printer memory, or alternatively may convert the data of the predetermined number of bits written in the printer memory to data representing a percentage.

In accordance with one preferable application of the present invention, the applicable technique determines whether or not the information on the quantity of ink written in the printer memory is coincident with the converted data of the specific number of bits written in the non-volatile memory at a time of a start of power supply. The technique applies the data of the predetermined number of bits stored in the printer memory for subsequent processing with regard to the quantity of ink in the cartridge, when it is determined that the information on the quantity of ink is coincident with the converted data of the specific number of bits. This arrangement enables the subsequent processing with regard to the quantity of ink to be carried out, based on the data of the greater number of bits stored in the printer memory, that is, the data with a higher accuracy, as long as the cartridge is not replaced with another.

In accordance with another preferable application of the present invention, the applicable technique determines whether or not the information on the quantity of ink written in the printer memory is coincident with the converted data of the specific number of bits written in the non-volatile memory at a time of a start of power supply. The technique re-converts the data of the specific number of bits written in the non-volatile memory into the data of the predetermined number of bits, writes the re-converted data of the predetermined number of bits as the information on the quantity of ink into the printer memory, and applies the re-converted data of the predetermined number of bits for subsequent processing with regard to the quantity of ink in the cartridge, when it is determined with the converted data of the specific number of bits. In this case, the subsequent processing with regard to the quantity of ink carried out, based on the data on the quantity of ink stored in the non-volatile memory of the cartridge.

In accordance with still another preferable application of the present invention, a piece of identification information that enables identification of the cartridge, is stored in the non-volatile memory of the cartridge. The applicable technique here reads the piece of identification information stored in the non-volatile memory at a time of a start of power supply and/or at a time of a replacement of the cartridge, and stores the read-out piece of identification information. The technique compares the read-out piece of identification information with the stored piece of identification information, which has been read out previously, so as to determine coincidence or non-coincidence thereof. The technique applies the data of the predetermined number of bits stored in the printer memory for subsequent processing with regard to the quantity of ink in the cartridge, when it is determined that the read-out piece of identification information is coincident with the stored piece of identification information. In this configuration, the cartridge is identified accurately using the identification information of the cartridge. This arrangement enables the subsequent processing with regard to the quantity of ink to be carried out, based on the data of the greater number of bits stored in the printer memory.

In the above structure, the applicable technique compares the read-out piece of identification information with the stored piece of identification information, which has been read out previously, so as to determine coincidence or non-coincidence thereof. The technique re-converts the data of the specific number of bits written in the non-volatile memory into the data of the predetermined number of bits, writes the re-converted data of the predetermined number of bits as the information on the quantity of ink into the printer memory, and applies the re-converted data of the predetermined number of bits for subsequent processing with regard to the quantity of ink in the cartridge, when it is determined that the read-out piece of identification information is not coincident with the stored piece of identification information. In this case, the subsequent processing with regard to the quantity of ink is carried out, based on the data on the quantity of ink stored in the non-volatile memory of the cartridge.

It is preferable that not only the information on the quantity of ink with regard to the cartridge currently attached to the printer but the same information with regard to all the cartridges that have been attached to the printer at least once is stored in the printer memory. In this configuration, a piece of identification information that enables identification of the cartridge is stored in the non-volatile memory of the cartridge. The piece of identification information stored in the non-volatile memory is read at a time of a start of power supply and/or at a time of a replacement of the cartridge. By utilizing the read-out piece of identification information, the information on the quantity of ink with regard to each cartridge having a different piece of identification information is stored into the printer memory. In the case of a replacement of the cartridge, the applicable technique retrieves data stored in the printer memory utilizing the piece of identification information read from the non-volatile memory, so as to determine whether or not an identical piece of identification information, which is identical with the read-out piece of identification information and represents an identical cartridge, is present in the printer memory. When it is determined that the identical place of identification information is present in the printer memory, the technique applies the information on the quantity of ink corresponding to the identical piece of identification information for subsequent processing with regard to the quantity of ink in the cartridge. This arrangement enables the processing with regard to the quantity of ink to be carried out with high accuracy even when a plurality of cartridges are successively attached to the printer and used for printing.

In accordance with one application of this structure, when it is determined that the identical piece of identification information is present in the printer memory, the applicable technique determines whether or not the information on the quantity of ink, which corresponds to the identical piece of identification information and is written in the printer memory, is coincident with the converted data of the specific number of bits written in the non-volatile memory. The technique applies the data of the predetermined number of bits, which corresponds to the identical piece of identification information and is stored in the printer memory, for subsequent processing with regard to the quantity of ink in the cartridge, when it is determined that the information on the quantity of ink is coincident with the converted data of the specific number of bits. The structure of this application determines the coincidence with regard to the information on the quantity of ink as well as with regard to the piece of identification information. This arrangement enables the accurate piece of information to be extracted and used as the information on the quantity of ink with regard to the cartridge currently attached to the printer.

In accordance with another application of this structure, when it is determined that the information on the quantity of ink, which corresponds to the identical piece of identification information and is written in the printer memory, is not coincident with the converted data of the specific number of bits written in the non-volatile memory, the applicable technique re-converts the data of the specific number of bits written in the non-volatile memory into the data of the predetermined number of bits, writes the re-converted data of the predetermined number of bits as the information on the quantity of ink corresponding to the identical piece of identification information into the printer memory, and applies the re-converted data of the predetermined number of bits for subsequent processing with regard to the quantity of ink in the cartridge. In this case, the subsequent processing with regard to the quantity of ink stored in the non-volatile memory of the cartridge.

In the configuration that carries out the processing with regard to the quantity of ink by taking advantage of the data stored in the two different memories, it is practical that the printer memory has a greater storage capacity than the non-volatile memory included in the cartridge. Incorporating the memory of a large storage capacity in the expendable cartridge is not desirable from both the view points of cost and resource saving.

It is also preferable that the printer memory enables a higher-speed access than the non-volatile memory included in the cartridge. Since the data of the greater number of bits are written into the printer memory, the memory that enables the higher-speed access is desirable.

Data may be written into the non-volatile memory of the cartridge at a variety of timings. For example, the data may be written into the non-volatile memory of the cartridge at a power-off time of the printer and/or at a time of a replacement of the cartridge. This arrangement enables the data stored in the cartridge to be updated when the cartridge is detached from the printer.

The data may be written into the printer memory when a printing operation has been completed with regard to one page and/or with regard to at least one raster line. It is also preferable that the data in the printer memory are updated at a high frequency, whereas data in the non-volatile memory of the cartridge are updated at a lower frequency.

In accordance with one preferable embodiment of the present invention, the printer has a cleaning unit that carries out head cleaning in response to a predetermined operation, wherein the head cleaning causes a preset quantity of ink to be transferred from the print head. In this structure, data are written into the printer memory when the cleaning unit carries out the head cleaning. The ink jet printer may have a cleaning function to prevent nozzles formed on the print head from being clogged. The cleaning operation naturally consumes a certain quantity of ink. It is accordingly preferable to update the information on the quantity of ink after each cleaning operation.

A variety of known memories may be applicable for the non-volatile memory mounted on the cartridge. For example, a memory that transmits data by serial access may be used for the non-volatile memory. This type of memory is generally inexpensive and has a less number of terminals as a chip, which leads to the effect of resource saving, although the storage capacity is relatively small. In this case, data are written into the non-volatile memory is synchronism with a clock for specifying an address.

The clock for specifying the address may be output from a control IC that directly controls a writing operation of data into the non-volatile memory. In this case, the printer memory may be disposed inside the control IC or alternatively outside the control IC.

In one preferable embodiment of the printer, the cartridge is detachably attached to a carriage, which has the print head mounted thereon and moves forward and backward relative to the printing medium. In this case, the printer memory may be mounted on the carriage. In the case where the control IC receives data from a controller of the printer, for example, via communications, it is preferable that the printer memory is located at the vicinity of the control IC. The principle of the present invention is applicable to the structure in which the [ink] cartridge is not mounted on the carriage but is set in the printer main body.

The structure of incorporating the non-volatile memory in the cartridge is applicable to any type of the cartridge. For example, in the case where both a black ink cartridge, in which black ink is kept, and a color ink cartridge, in which a plurality of different color inks are kept, are detachably attached to the printer, the non-volatile memory is provided in both the black cartridge and the color ink cartridge, and data are written into the respective non-volatile memories. The configuration that provides a non-volatile memory for each cartridge enables the data on the quantity of ink with regard to each cartridge to be processed independently. The principle of the present invention is also applicable to a printer, to which only a black ink cartridge or a color ink cartridge is detachably attached.

The present invention is also directed to a method of managing information in a printer, to which a cartridge is detachably attached, wherein the cartridge keeps ink therein and has a rewritable non-volatile memory and the printer causes the ink kept in the cartridge to be transferred from a print head mounted on the printer to a printing medium, thereby implementing a printing operation. The method includes the steps of: writing information on a quantity of ink in the cartridge, which is consumed with a progress of a printing operation on the printing medium, as data of a predetermined number of bits, into a rewritable printer memory incorporated in a main body of the printer; and converting the information on the quantity of ink in the cartridge to data of a specific number of bits, which is less than the predetermined number of bits, and writing the converted data of the specific number of bits into the non-volatile memory included in the cartridge.

This method of managing the information on the quantity of ink enables the data of the greater number of bits, that is, the data with a high accuracy, to be stored in the printer memory, without applying an excessive load to the non-volatile memory of the cartridge, which has a smaller storage capacity. This arrangement thus enables the information on the quantity of ink in the cartridge to be managed in an appropriate manner.

The method of the present invention may be actualized by a printer or a computer that is connected to the printer. In the latter case, the principle of the present invention is attained by a computer program products or a recording medium, in which a program executed by the computer is recorded. The present invention is accordingly directed to computer program products, in which a specific program is recorded in a computer readable recording medium. The specific program is used to a manage information in a printer, to which a cartridge is detachably attached, wherein the cartridge keeps ink therein and has a rewritable non-volatile memory and the printer causes the ink kept in the cartridge to be transferred from a print head mounted on the printer to a printing medium, thereby implementing a printing operation. The specific program includes: a first program code that causes a computer to write information on a quantity of ink in the cartridge, which is consumed with a progress of a printing operation on the printing medium, as data of a predetermined number of bits, into a rewritable printer memory incorporated in a main body of the printer; and a second program code that causes the computer to convert the information on the quantity of ink in the cartridge to data of a specific number of bits, which is less than the predetermined number of bits, and write the converted data of the specific number of bits into the non-volatile memory included in the cartridge.

The computer reads the recording medium and executes the program codes of the specific program recorded on the recording medium, thereby actualizing the method of managing information discussed above.

The present invention is further directed to a cartridge that keeps ink therein and has a rewritable non-volatile memory. The cartridge is detachably attached to a printer. Information on a quantity of ink in the cartridge, which is consumed with a progress of a printing operation, is written into the non-volatile memory as data of a specific number of bits, which is less than a predetermined number of bits allocated to data stored in the printer.

In the cartridge of the present invention, the information on the quantity of ink is written into the non-volatile memory of the cartridge as data of a specific number of bits, which is less than a predetermined number of bits allocated to data stored in the printer. This arrangement advantageously reduces the required storage capacity of the non-volatile memory.

In the cartridge of the present invention, it is preferable that the information on the quantity of ink is written into the non-volatile memory at a power-off time of the printer and/or at a time of a replacement of the cartridge. Updating the information on the quantity of information at these timings enables the information regarding the latest quantity of ink to be kept in the non-volatile memory of the cartridge, even when a replacement of the cartridge is required unexpectedly.

An EEPROM or a flash memory may be used for the non-volatile memory of the cartridge. Another available structure backs up the contents in a memory by means of a battery, so as to make the memory backed up by battery non-volatile. A bubble memory or a micro-miniature hard disk may also be applicable for the non-volatile memory.

A memory that transmits data by serial access may be applicable for the non-volatile memory. In this case, the information on the quantity of ink is written into the non-volatile memory in synchronism with a clock for specifying an address. The memory of the serial access type is small-sized and has a less number of terminals, thereby attaining the effect of resource saving.

The data written into the non-volatile memory may be obtained by omitting lower bits from the data of the predetermined number of bits stored in the printer or by converting the data of the predetermined number of bits stored in the printer to data representing a percentage. The only requirement is that the data written into the non-volatile memory should have a smaller number of bits and correspond to the data stored in the printer.

In accordance with one preferable application of the present invention, the cartridge has an ink reservoir, in which a plurality of different inks are kept. The data of the specific number of bits are written with regard to each of the plurality of different inks into the non-volatile memory. This arrangement enables plural pieces of information regarding the quantities of the plurality of different inks to be stored in one non-volatile memory.

In one embodiment of the cartridge with a plurality of different inks kept therein, the ink reservoir is divided into at least three ink chambers, in which at least three different inks are kept, and the non-volatile memory has a plurality of information storage areas, in each of which information on a quantity of each of the at least three different inks is stored independently. A storage capacity of not greater than 2 bytes is allocated respectively to the plurality of information storage areas.

In this structure of the embodiment, the storage capacity of not greater than 2 bytes is allocated to each ink. When the cartridge has three different inks kept therein, the total storage capacity required for storing the information on the quantities of the three different inks is not greater than 6 bytes. In the case where the ink reservoir is divided into five ink chambers, in which five different inks are kept, the total storage capacity required for storing the information on the quantities of the five different inks is not greater than 10 bytes.

In any of the applications of the present invention discussed above, the information on the quantity of ink may be the remaining quantity of ink or a cumulative amount of ink consumption with regard to the cartridge. The information may otherwise be an amount of ink consumption while the cartridge of interest is attached to the printer. There is a cartridge that can be refilled with ink. The cartridge of this type is detached from the printer, refilled with ink, and attached again to the printer, for example, in response to an instruction of 'refill' displayed on the switch panel. In this case, it is required to monitor the amount of ink consumption while the cartridge is attached to the printer.

These and other objects, features, aspects, and advantages of the present invention will become more apparent from the following detailed description of the preferred embodiments with the accompanying drawings.

BRIEF DESCRIPTION OF THE DRAWINGS

FIG. 8 shows a data array in the storage element 80 incorporated in the black ink cartridge 107K attached to the printer 1 shown in FIG. 1;

FIG. 9 shows a data array in the storage element 80 incorporated in the color ink cartridge 107F attached to the printer 1 shown in FIG. 1;

FIG. 10 shows a data array in an EEPROM 90 incorporated in the print controller 40 of the printer 1 shown in FIG. 1;

FIG. 19 is a table showing serial numbers provided as identification information.

DESCRIPTION OF THE PREFERRED EMBODIMENT

[First Embodiment]

(General Structure of Printing Apparatus)

Figure 1:
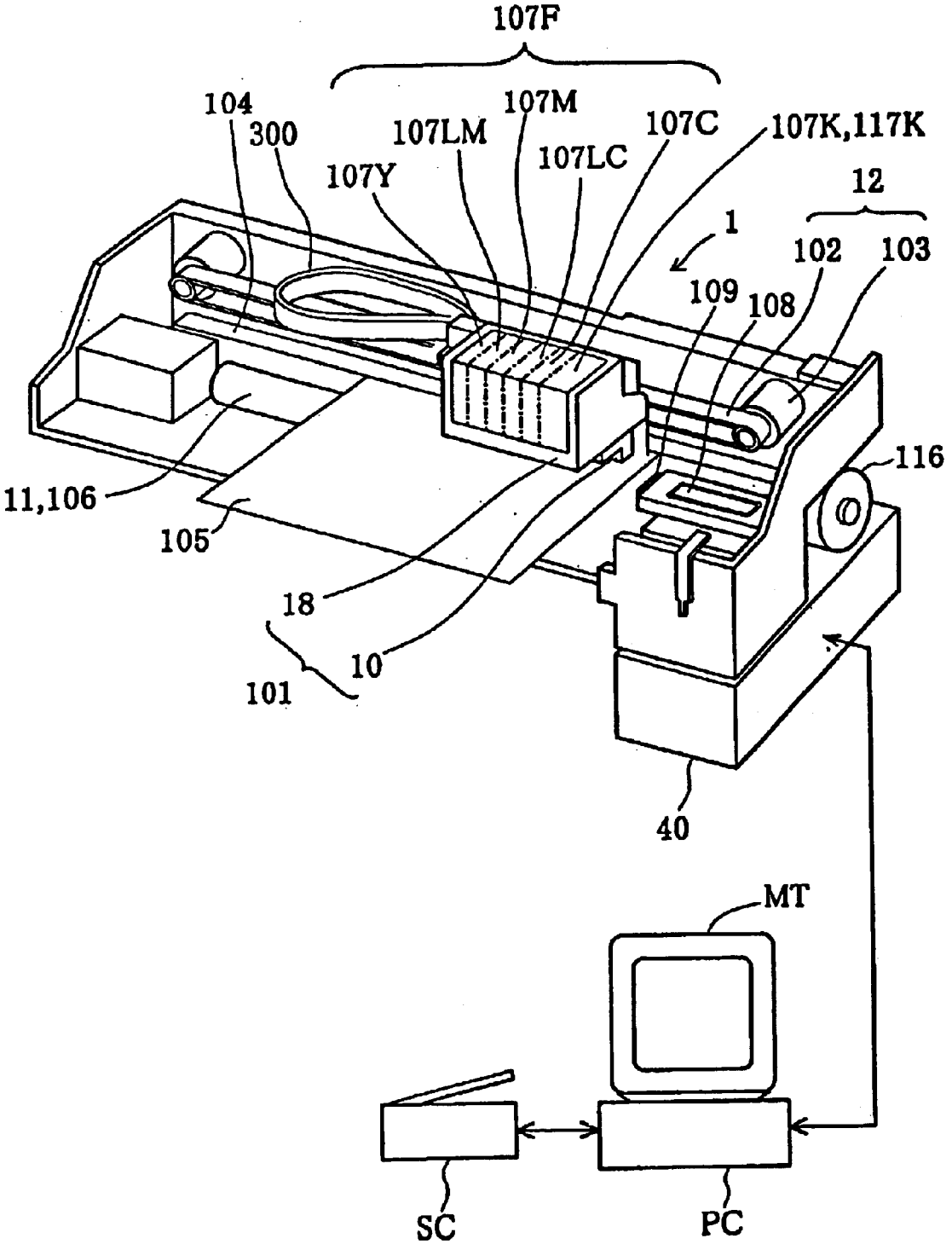
FIG. 1 is a perspective view illustrating the structure of a main part of a printer 1 in one embodiment according to the present invention.

FIG. 1 is a perspective view illustrating the structure of a main part of an ink jet printer 1 in one embodiment according to the present invention. The printer 1 of the embodiment is used in connection with a computer PC, to which a scanner SC is also connected. The computer PC reads and executes an operating system and predetermined programs to function, in combination with the printer 1, as a printing apparatus. The computer PC executes an application program on a specific operating system, carries out processing of an input image, for example, read from the scanner SC, and displays a processed image on a CRT display MT. When the user gives a printing instruction after the required image processing, for example, retouching the image on the CRT display. MT, is concluded, a printer driver incorporated in the operating system is activated to transfer processed image data to the printer 1. A CD drive (not shown) that reads a recording medium, such as a CD-ROM, and other non-illustrated drives are mounted on the computer PC.

The printer driver converts original color image data, which are input from the scanner SC and subjected to the required image processing, to color image data printable by the printer 1 in response to the printing instruction, and outputs the converted color image data to the printer 1. The original color image data consists of three color components, that is, red (R), green (G), and blue (B). The converted color image data printable by and output to the printer 1 consists of six color components, that is, black (K), cyan (C), light cyan (LC), magenta (M), light magenta (LA), and yellow (Y). The printable color image data are further subjected to binary processing, which specifies the on-off state of ink dots. These image processing and data conversion processes are known in the art and are thus not specifically described here. These processes may be carried out in the printer 1, in place of the printer driver included in the computer PC, as discussed later.

The following describes the basic structure of the printer 1. Referring to FIG. 1 and the block diagram of FIG. 2, the printer 1 has a print controller 40 that is in charge of control procedures and a print engine 5 that actually performs ejection of ink. The print controller 40 and the print engine 5 are incorporated in a printer main body 100. The print engine 5 included in the printer main body 100 has a print head 10, a sheet feed mechanism 11, and a carriage mechanism 12. The print head 10 is integrally formed with a cartridge attachment unit 18 to construct a carriage 101. The print head 10, which is an ink jet type, is mounted on a specific face of the carriage 101 that faces a sheet of printing paper 105, that is, a lower face of the carriage 101 in this embodiment. Transfer of print data to the print head 10 is carried out via a flexible print cable (FPC) 300. The carriage mechanism 12 includes a carriage motor 103 and a timing belt 102. The carriage motor 103 drives the carriage 101 via the timing belt 102. The carriage 101 is guided by a guide member 104 and moves forward and backward along a width of the printing paper 105 by means of normal and reverse rotations of the carriage motor 103. The sheet feed mechanism 11 that feeds the printing paper 105 includes a sheet feed roller 106 and a sheet feed motor 116.

A black ink cartridge 107K and a color ink cartridge 107F, which will be described later, are detachably attached to the cartridge attachment unit 18 of the carriage 101. The print head 10 receives supplies of inks fed from these ink cartridges 107K and 107F and ejects ink droplets against the printing paper 105 with a movement of the carriage 101, so as to create dots and print a picture image or letters on the printing paper 105.

Each of the ink cartridges 107K and 107F has a cavity therein for keeping ink, which is prepared by dissolving or dispersing a dye or a pigment in a solvent. The cavity for keeping ink therein is generally referred to as an ink chamber. The black ink cartridge 107K has an ink chamber 117K, in which black ink (K) is kept. The color ink cartridge 107F has a plurality of ink chambers 107C, 107LC, 107M, 107LM, and 107Y, which are formed separately. Cyan ink (C), light cyan ink (LC), magenta ink (M), light magenta ink (LM), and yellow ink (Y) are kept respectively in these ink chambers 107C, 107LC, 107M, 107LM, and 107Y. The print head 10 receives supplies of various color inks fed from the respective ink chambers 107C, 107LC, 107M, 107LM, and 107Y, and ejects ink droplets of various colors to implement color printing.

A capping unit 108 and a wiping unit 109 are disposed on one end of the printer 1, which is included in a non-printable area. The capping unit 108 closes nozzle opening formed on the print head 10 during the stoppage of printing operation. The capping unit 108 effectively prevents the solvent component in the ink from being vaporized during the stoppage of printing operation. Preventing the vaporization of the solvent component in the ink favorably depresses an increase in viscosity of ink and formation of an ink film. Capping the nozzle openings during the stoppage of printing operation effectively prevents the nozzles from being clogged. The capping unit 108 also has a function of collecting ink droplets ejected from the print head 10 by a flushing operation. The flushing process is carried out to eject ink when the carriage 101 reaches the end of the printer 1 during the execution of the printing operation. The flushing process is one of the actions for preventing the nozzles from being clogged. The wiping unit 109 is located in the vicinity of the capping unit 108 to wipe the surface of the print head 10, for example, with a blade, so as to wipe out the ink residue or paper dust adhering to the surface of the print head 10. In addition to these actions, the printer 1 of the embodiment carries out a sucking operation with regard to the nozzles, for example, in the case of abnormality occurring due to invasion of bubbles into the nozzles. The sucking process presses the capping unit 108 against the print head 10 to seal the nozzle openings, activates a suction pump (not shown), and makes a passage connecting with the capping unit 108 in a negative pressure, so as to cause ink to be sucked out of the nozzles on the print head 10. The flushing operation, the wiping operation, and the sucking operation are included in a head cleaning procedure. The wiping operation may be carried out by an automatic mechanism that uses a preset blade and automatically wipes the surface of the print head 10 with forward and backward movements of the carriage 101. In this case, only the flushing operation and the sucking operation are included in the active head cleaning procedure.

Figure 2:
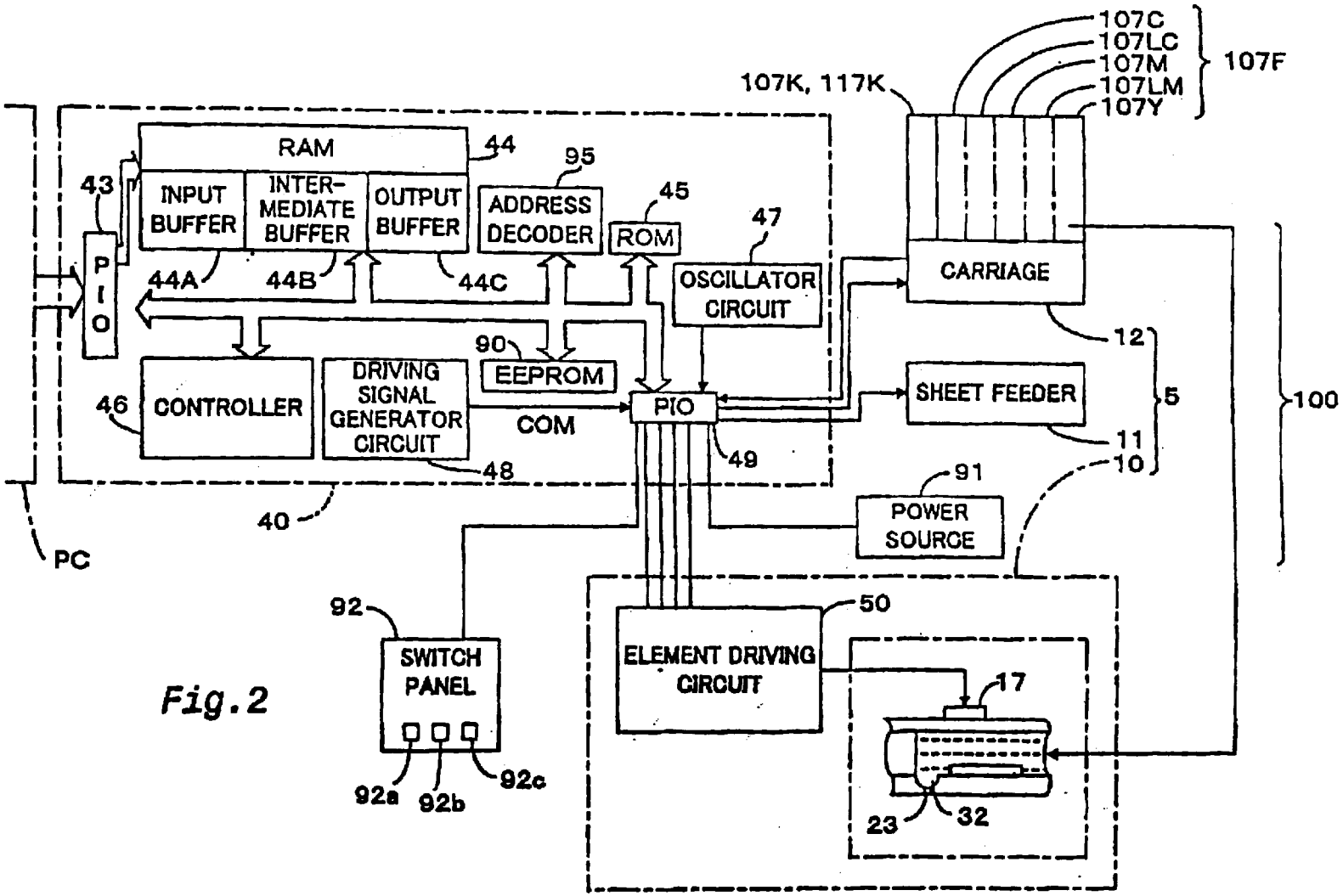
FIG. 2 is a block diagram illustrating the internal structure of the printer 1 including a print controller 40.

The control circuit of the printer 1 is discussed with FIG. 2, which is a functional block diagram showing the internal structure of the ink jet printer 1 of the embodiment. The print controller 40 has an interface 43 that receives various data, such as print data, transmitted from the computer PC, a RAM 44 in which the various data including print data are stored, and a ROM 45 in which programs for various data processing are stored. The print controller 40 further has a controller 46 including a CPU, an oscillator circuit 47, a driving signal generator circuit 48 that generates a driving signal COM given to the print head 10, and a parallel input-output interface 49 that transmits the print data developed to dot pattern data and the driving signal COM to the print engine 5.

Control lines of a switch panel 92 and a power source 91 are also connected to the print controller 40 via the parallel input-output interface 49. The switch panel 92 has a power switch 92*a* for turning the power source 91 on and off, a cartridge switch 92*b* for giving an instruction to replace the ink cartridge currently attached to the printer 1 with another ink cartridge, and a cleaning switch 92*c* for giving an instruction to perform the forcible cleaning of the print head 10. When the power switch 92*a* on the switch panel 92 is operated to input an instruction of a power-off operation, a requirement of non-maskable interruption NMI is generated. The print controller 40 immediately shifts to a predetermined interruption process and outputs a power down instruction to the peripheral circuit including the power source 91, in response to the requirement of non-maskable interruption NMI. The power source 91 receives the power down instruction and falls into a stand-by state. In the stand-by state, the power source 91 supplies a stand-by electric power to the print controller 40 via a power supply line (not shown), while stopping the main power supply. The standard power-off operation carried out via the switch panel 92 thus does not completely cut off the power supply to the print controller 40.

The requirement of non-maskable interruption NMI is also output when the cartridge switch 92*b* on the switch panel 92 is operated to give an instruction of replacing the ink cartridge, and when the power plug is pulled out of the socket. In response to the output of the requirement of non-maskable interruption NMI, the print controller 40 executes an interruptive processing routine discussed later. In the interruptive processing routine, the case of an output of the requirement of interruption NMI due to an operation of a switch on the switch panel 92 is distinguishable from the case of an output of the requirement of interruption NMI due to the forcible cut-off of the power supply. Different processes may thus be carried out according to the cause of the output of the requirement of interruption NMI, as discussed later. The power source 91 has an auxiliary power unit, for example, a capacitor, to ensure a power supply for a predetermined time period, for example, 0.3 seconds, after the power plug is pulled out of the socket.

The print controller 40 has an EEPROM 90 mounted thereon as a memory of the printer main body 100, which stores information relating to the black ink cartridge 107K and the color ink cartridge 107F mounted on the carriage 101 as shown in FIG. 1. The EEPROM 90 stores plural pieces of specific information including information relating to quantities of inks in the black ink cartridge 107K and the color ink cartridge 107F, as discussed later in detail. The ink quantity-relating information may regard the remaining quantities of the respective inks in the ink cartridges 107K and 107F or the amounts of consumption of the respective inks with regard to the ink cartridges 107K and 107F. The print controller 40 also has an address decoder 95, which converts desired addresses in a memory cell 81 (described later) of a storage element 80 (described later), at which the controller 46 requires to gain accesses (read and write), into numbers of clocks. The controller 46 in the print controller 40 generally processes data by the unit of 8 bits or 1 byte. The memory cell 81 of the storage element 80 incorporated in the ink cartridges 107K and 107F is serially accessed in synchronism with reading and writing clocks. The address decoder 95 accordingly converts the addresses to be accessed into the numbers of clocks.

The printer 1 determines the amount of ink consumption by calculation. The calculation of the amount of ink consumption may be carried out by the printer driver incorporated in the computer PC or by the printer 1. The calculation of the amount of ink consumption is performed by taking into account the following two factors:

(1) Amount of ink consumption by printing an image:

In order to accurately calculate the amount of ink consumption in the process of printing, image data are subjected to color conversion and binarization processes and converted to on-off data of ink dots. With regard to the image data in the on condition of ink dots, the weight of each dot is multiplied with the number of dots. Namely the frequency of ejection of ink droplets from the nozzle openings 23 is multiplied by the weight of each ink droplet. The amount of ink consumption may be approximated from the densities of the respective pixels included in the image data.

(2) Amount of ink consumption by cleaning the print head 10:

The amount of ink consumption by cleaning the print head 10 includes an amount of ink ejection by the flushing operation and an amount of ink suction by the sucking operation. The action of the flushing operation is identical with the normal ejection of ink droplets, and the amount of ink ejection by the flushing operation is thus calculated in the same manner as described in the factor (1). The amount of ink consumption by the sucking operation is stored in advance according to the revolving speed and the activation time of the sucking pump. The amount of ink consumed by one sucking action is generally measured and stored in advance.

The current remaining quantity of ink is determined by subtracting the calculated amount of ink consumption from the previous remaining quantity of ink prior to the current printing operation. The controller 46 carries out the calculation of the remaining quantity of ink according to a specific program, for example, one stored in the ROM 45, using data stored in the EEPROM 90.

In the arrangement of this embodiment, the color conversion and binarization processes are performed by the printer driver in the computer PC as described previously. The printer 1 thus receives the binary data, that is, the data on the dot on-off conditions with regard to each ink. The printer 1 multiplies the weight of ink for each dot (that is, the weight of each ink droplet) by the number of dots to determine the amount of ink consumption, based on the input binary data.

The ink jet printer 1 of the embodiment receives the binary data as described previously. The array of the binary data is, however, not coincident with the nozzle array on the print head 10. The controller 46 accordingly divides the RAM 44 into three portions, that is, an input buffer 44A, an intermediate buffer 44B, and an output buffer 44C, in order to perform the rearrangement of the dot data array. The ink jet printer 1 may alternatively carry out the required processing for the color conversion and the binarization. In this case, the ink jet printer 1 registers the print data, which include the multi-tone information and are transmitted from the computer PC, into the input buffer 44A via the interface 43. The print data kept in the input buffer 44A are subjected to command analysis and then transmitted to the intermediate buffer 44B. The controller 46 converts the input print data into intermediate codes by supplying information regarding the printing positions of the respective letters or characters, the type of modification, the size of the letters or characters, and the font address. The intermediate codes are kept in the intermediate buffer 44B. The controller 46 then analyzes the intermediate codes kept in the intermediate buffer 44B and decodes the intermediate codes into binary dot pattern data. The binary dot pattern data are expanded and stored in the output buffer 44C.

In any case, when dot pattern data corresponding to one scan of the print head 10 are obtained, the dot pattern data are serially transferred from the output buffer 44C to the print head 10 via the parallel input-output interface 49. After the dot pattern data corresponding to one scan of the print head 10 are output from the output buffer 44C, the process erases the contents of the intermediate buffer 44B to wait for conversion of a next set of print data.

The print head 10 causes the respective nozzle openings 23 to eject ink droplets against the printing medium at a predetermined timing, so as to create an image corresponding to the input dot pattern data on the printing medium. The driving signal COM generated in the driving signal generator circuit 48 is output to an element driving circuit 50 in the print head 10 via the parallel input-output interface 49. The print head 10 has a plurality of pressure chambers 32 and a plurality of piezoelectric vibrators 17 (pressure-generating elements) respectively connecting with the nozzle openings 23. The number of both the pressure chambers 32 and the piezoelectric vibrators 17 is thus coincident with the number of the nozzle openings 23. When the driving signal COM is sent from the element driving circuit 50 to a certain piezoelectric vibrator 17, the corresponding pressure chamber 32 is contracted to cause the corresponding nozzle opening 23 to eject an ink droplet.

Figure 3:
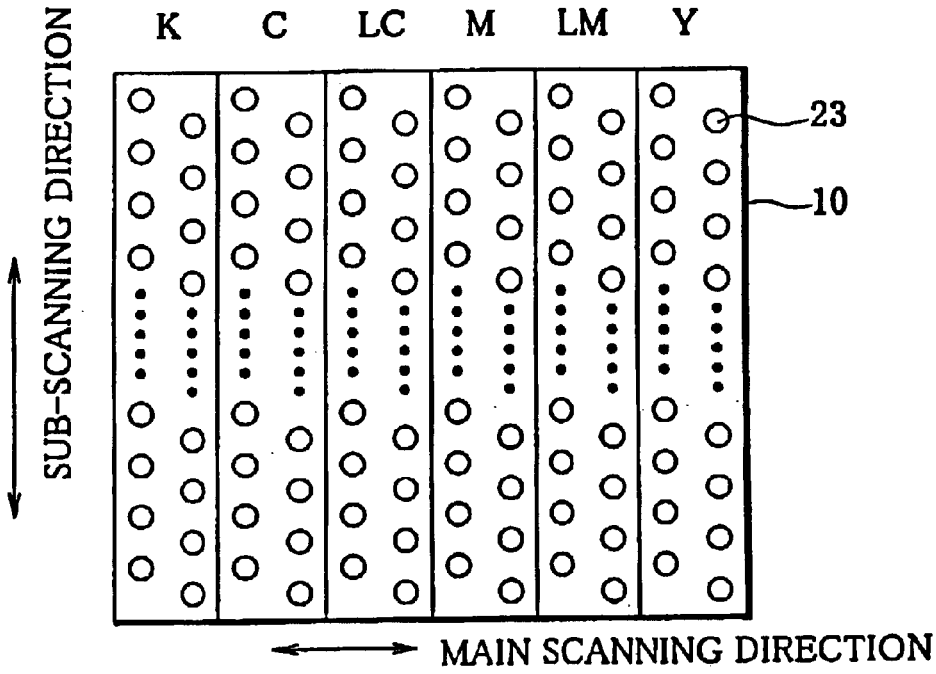
FIG. 3 shows a layout of nozzle openings 23 formed on the print head 10 shown in FIG. 1.

FIG. 3 shows an exemplified layout of the nozzle openings 23 on the print head 10. The print head 10 has a plurality of nozzle arrays respectively corresponding to the black ink (K), the cyan ink (C), the light cyan ink (LC), the magenta ink (M), the light magenta ink (LM), and the yellow ink (Y). Each nozzle array includes the nozzle openings 23 arranged in two lines and zigzag. (Structure of Ink Cartridges 107K, 107F and Cartridge Attachment Unit 18)

The black ink cartridge 107K and the color ink cartridge 107F, which are attached to the ink jet printer 1 having the above configuration, have a common basic structure. The following description regards the structure of the ink cartridge, the black ink cartridge 107K as an example, and the structure of the cartridge attachment unit 18 of the printer main body 100, which receives and holds the ink cartridge 107K, with reference to FIGS. 4A, 4B, and 5.

Figure 4A:
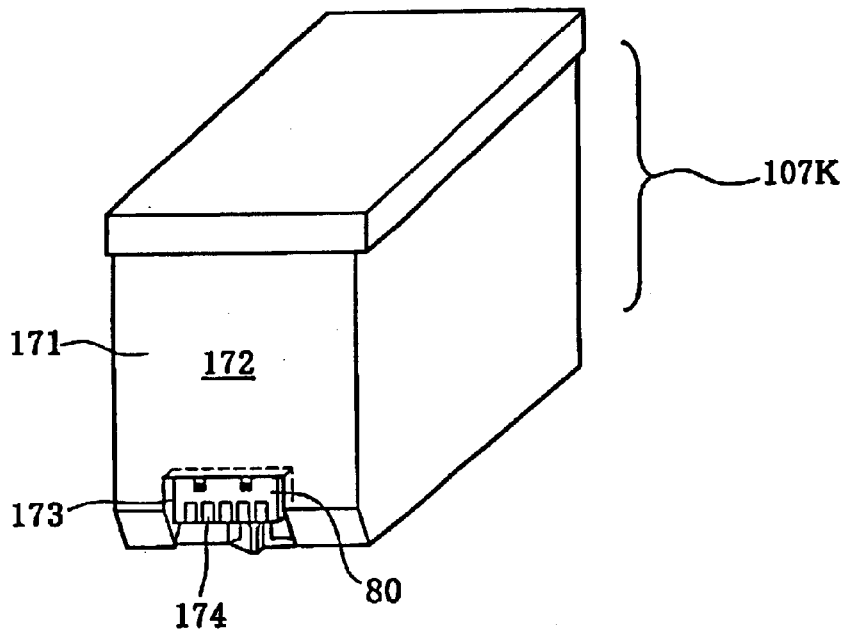
FIGS. 4A and 4B are perspective views respectively illustrating the structures of an ink cartridge 107K and a cartridge attachment unit 18.
Figure 4B:
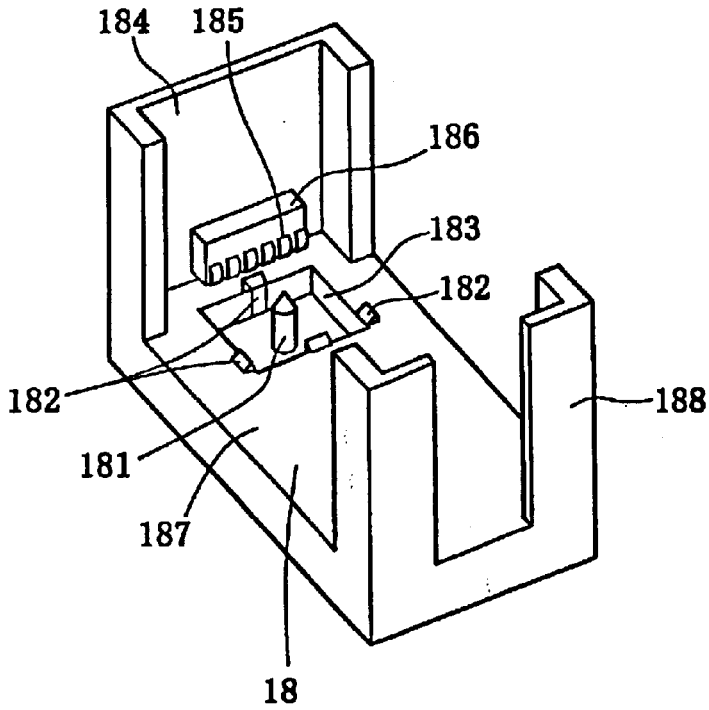
Figure 5:
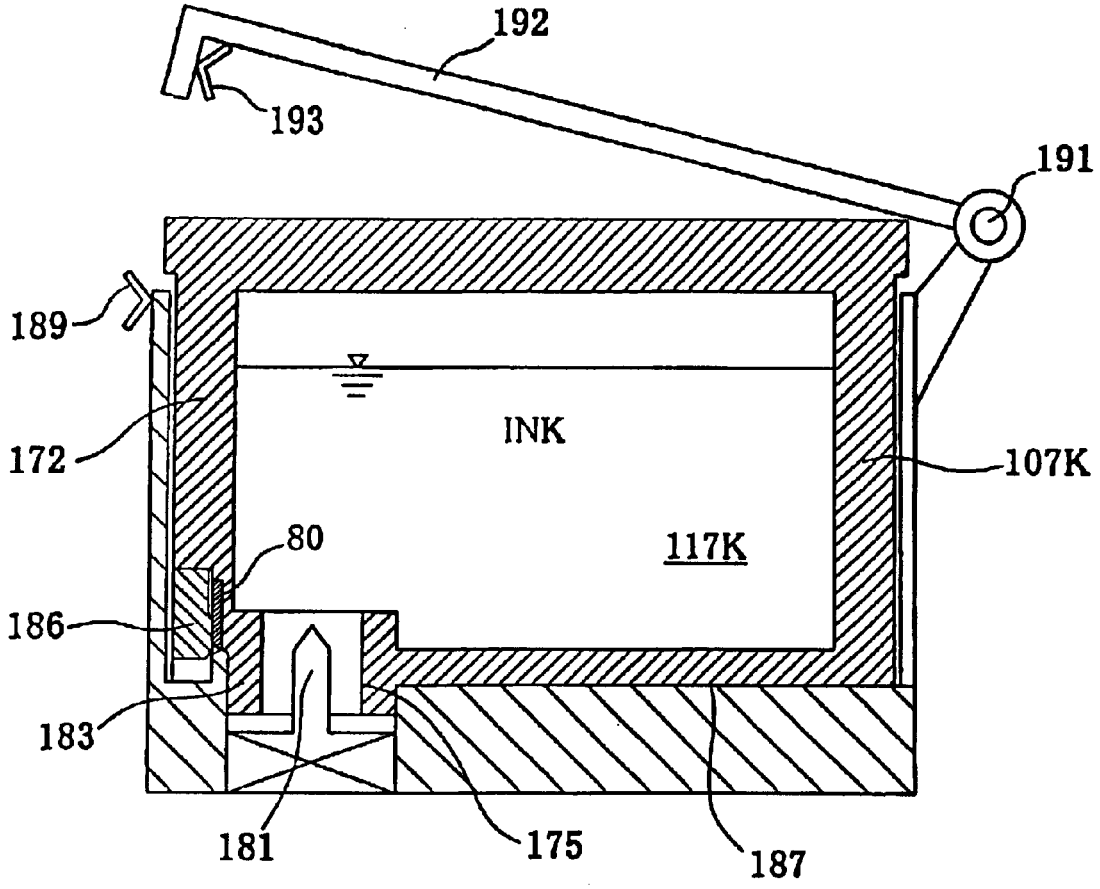
FIG. 5 is a sectional view illustrating an attachment state in which the ink cartridge 107K shown in FIG. 4A is attached to the cartridge attachment unit 18 shown in FIG. 4B.

FIGS. 4A and 4B are perspective views schematically illustrating the structures of the ink cartridge 107K and the cartridge attachment unit 18 of the printer main body 100. FIG. 5 is a sectional view illustrating an attachment state in which the ink cartridge 107K is attached to the cartridge attachment unit 18.

Referring to FIG. 4A, the ink cartridge 107K has a cartridge main body 171 that is composed of a synthetic resin and defines the ink chamber 117K in which black ink is kept, and a storage element (non-volatile memory) 80 incorporated in a side frame 172 of the cartridge main body 171. An EEPROM is generally applied for the storage element 80 that is rewritable by electrically erasing the non-required contents of storage and maintains the contents of storage even after the power supply is cut off. The allowable frequency of rewriting data in the storage element 80 is about ten thousand times, which is significantly lower than the allowable frequency of rewriting in the EEPROM 90 incorporated in the print controller 40. This makes the cost of the storage element 80 extremely low. The storage element 80 enables transmission of various data to and from the print controller 40 of the printer 1, while the ink cartridge 107K is attached to the cartridge attachment unit 18 of the printer main body 100 shown in FIG. 4B. The storage element 80 is received in a bottom-opened recess 173 formed in the side frame 172 of the ink cartridge 107K. The storage element 80 has a plurality of connection terminals 174 exposed to the outside in this embodiment. The whole storage element 80 may, however, be exposed to the outside. Alternatively the whole storage element 80 is embedded, and separate connection terminals may be provided independently.

Referring to FIG. 4B, the cartridge attachment unit 18 has an ink supply needle 181, which is disposed upward on a bottom 187 of a cavity, in which the ink cartridge 107K is accommodated. A recess 183 is formed about the needle 181. When the ink cartridge 107K is attached to the cartridge attachment unit 18, an ink supply unit 175 (see FIG. 5), which is projected from the bottom of the ink cartridge 107K, is fitted in the recess 183. Three cartridge guides 182 are set on the inner wall of the recess 183. A connector 186 is placed on an inner wall 184 of the cartridge attachment unit 18. The connector 186 has a plurality of electrodes 185, which are in contact with and thereby electrically connect with the plurality of connection terminals 174 of the storage element 80 when the ink cartridge 107K is attached to the cartridge attachment unit 18.

The ink cartridge 107K is attached to the cartridge attachment unit 18 according to the following procedure. When the user operates the cartridge switch 92*b* on the switch panel 92 to give an instruction of replacing the ink cartridge 107K, the carriage 101 shifts to a specific position that allows replacement of the ink cartridge 107K. The procedure of replacement first detaches the ink cartridge 107K currently attached to the printer 1. A lever 192 is fixed to a rear wall 188 of the cartridge attachment unit 18 via a support shaft 191 as shown in FIG. 5. The user pulls up the lever 192 to a release position, at which the ink cartridge 107K can be detached from the cartridge attachment unit 18. Another ink cartridge 107K is then located on the cartridge attachment unit 18, and the lever 192 is pressed down to a fixation position, which is over the ink cartridge 107K. The press-down motion of the lever 192 presses the ink cartridge 107K downward, so as to make the ink supply unit 175 fitted into the recess 183 and make the needle 181 pierce the ink supply unit 175, thereby enabling a supply of ink. As the lever 192 is further pressed down, a clutch 193 disposed on a free end of the lever 192 engages with a mating element 189 disposed on the cartridge attachment unit 18. This securely fixes the ink cartridge 107K to the cartridge attachment unit 18. In this state, the plurality of connection terminals 174 on the storage element 80 in the ink cartridge 107K electrically connect with the plurality of electrodes 185 on the cartridge attachment unit 18. This enables transmission of data between the printer main body 100 and the storage element 80. When the replacement of the ink cartridge 107K is completed and the user operates the switch panel 92 again, the carriage 101 returns to the initial position to be in the printable state.

The color ink cartridge 107F basically has a similar structure to that of the ink cartridge 107K, and only the difference is described here. The color ink cartridge 107F has five ink chambers in which five different color inks are kept. It is required to feed the supplies of the respective color inks to the print head 10 via separate pathways. The color ink cartridge 107F accordingly has five ink supply units 175, which respectively correspond to the five different color inks. The color ink cartridge 107F, in which five different color inks are kept, however, has only one storage element 80 incorporated therein. Pieces of information regarding the ink cartridge 107F and the five different color inks are collectively stored in this storage element 80.

Figure 6:
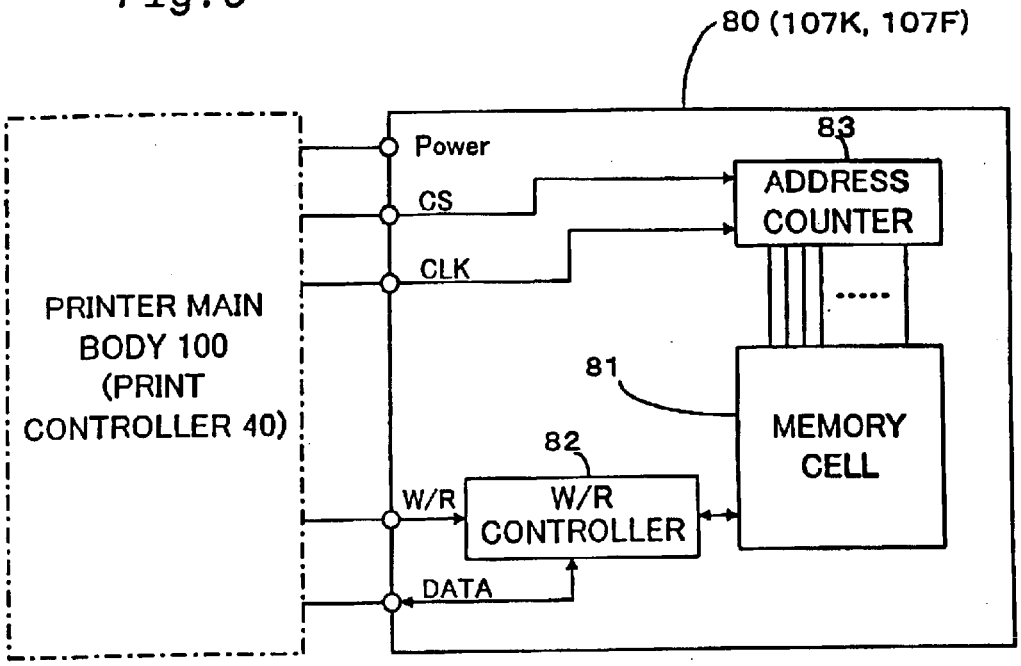
FIG. 6 is a block diagram showing the configuration of a storage element 80 incorporated in the ink cartridges 107K and 107F attached to the printer 1 shown in FIG. 1.
Figure 7A:
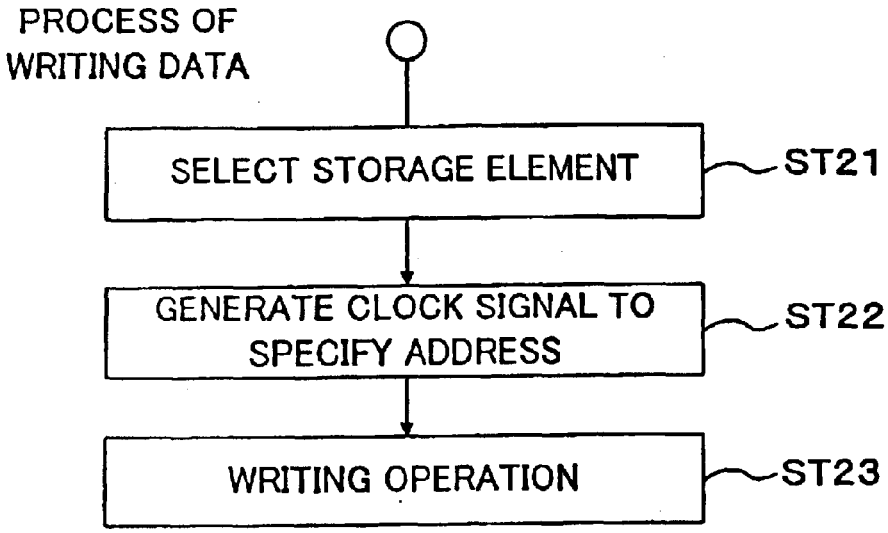
FIG. 7A is a flowchart showing a processing routine to write data into the storage element 80.
Figure 7B:
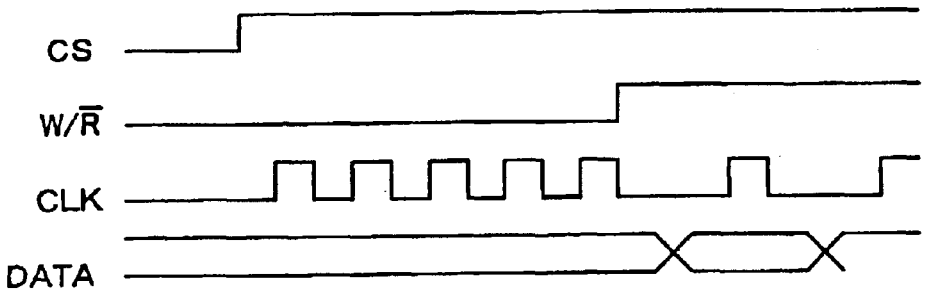
FIG. 7B is a timing chart showing the timing of execution of the processing shown in the flowchart of FIG. 7A.

FIG. 6 is a block diagram showing the configuration of the storage element 80 incorporated in the ink cartridges 107K and 107F attached to the ink jet printer 1 of the embodiment. FIGS. 7A and 7B show a data writing process into the memory cell 81.

As shown in the block diagram of FIG. 6, the storage element 80 of the ink cartridges 107K and 107F includes the memory cell 81, a read/write controller 82, and an address counter 83. The read/write controller 82 is a circuit that controls reading and writing operations of data from and into the memory cell 81. The address counter 83 counts up in response to a clock signal CLK and generates an output that represents an address with regard to the memory cell 81.

The actual procedure of writing operation is described with reference to FIGS. 7A and 7B. FIG. 7A is a flowchart showing a processing routine executed by the print controller 40 in the printer 1 of the embodiment to write the remaining quantities of inks into the storage elements 80 incorporated in the black and color ink cartridges 107K and 107F, and FIG. 7B is a timing chart showing the timing of execution of the processing shown in the flowchart of FIG. 7A.

The controller 46 of the print controller 40 first makes a chip select signal CS, which sets the storage element 80 in an enabling state, in a high level at step ST21. While the chip select signal CS is kept at the low level, the count on the address counter 83 is set equal to zero. When the chip select signal CS is set to the high level, the address counter 83 is enabled to start the count. The controller 46 then generates a required number of pulses of the clock signal CLK to specify an address, at which data are written, at step ST22. The address decoder 95 incorporated in the print controller 40 is used to determine the required number of pulses of the clock signal CLK. The address counter 83 included in the storage element 80 counts up in response to the required number of pulses of the clock signal CLK thus generated. During this process, a read/write signal R/W is kept in a low level. This means that an instruction of reading data is given to the memory cell 81. Dummy data are accordingly read synchronously with the output clock signal CLK.

After the address counter 83 counts up to the specified address for writing data, the controller 46 carries out an actual writing operation at step ST23. The writing operation switches the read/write signal R/W to the high level, outputs one-bit data to a data terminal I/O, and changes the clock signal CLK to a high active state on the completion of data output. While the read/write signal R/W is in the high level, data DATA of the data terminal I/O are written into the memory cell 81 of the storage element 80 synchronously with a rise of the clock signal CLK. Although the writing operation starts synchronously with a fifth pulse of the clock signal CLK in the example of FIG. 7B, this only describes the general writing procedure. The writing operation of required data, for example, the remaining quantity of ink, may be carried out at any pulse, for example, at a first pulse, of the clock signal CLK according to the requirements.

Data arrays of the storage elements 80, in which data are written, are described with reference to FIGS. 8 and 9. FIG. 8 shows a data array in the storage element 80 incorporated in the black ink cartridge 107K attached to the printer 1 of this embodiment shown in FIG. 1. FIG. 9 shows a data array in the storage element 80 incorporated in the color ink cartridge 107F attached to the printer 1. FIG. 10 shows a data array in the EEPROM 90 incorporated in the print controller 40 of the printer main body 100.

Referring to FIG. 8, the memory cell 81 of the storage element 80 incorporated in the black ink cartridge 107K has a first storage area 750, in which read only data are stored, and a second storage area 760, in which rewritable data are stored. The printer main body 100 can only read the data stored in the first storage area 750, while performing both the reading and writing operations with regard to the data stored in the second storage area 760. The second storage area 760 is located at a specific address, which is accessed prior to the first storage area 750 in the state without no specific processing, that is, in the case of default. Namely the second storage area 760 has a lower address than that of the first storage area 750. In the specification hereof, the expression 'lower address' means an address closer to the head of the memory space.

In the second storage area 760, data regarding the frequency of attachment of the ink cartridge is registered in a head portion 700 thereof. First data on the remaining quantity of black ink and second data on the remaining quantity of black ink are respectively allocated to first and second black ink remaining quantity memory divisions 701 and 702, which follow the head portion 700 and are accessed in this order.

There are the two black ink remaining quantity memory divisions 701 and 702 for storing the data on the remaining quantity of black ink. This arrangement enables the data on the remaining quantity of black ink to be written alternately in these two memory divisions 701 and 702. If the latest data on the remaining quantity of black ink is stored in the first black ink remaining quantity memory division 701, the data on the remaining quantity of black ink stored in the second black ink remaining quantity memory division 702 is the previous data immediately before the latest data, and the next writing operation is performed in the second black ink remaining quantity memory division 702.

Both the first and second black ink remaining quantity memory divisions 701 and 702 have a storage capacity of 1 byte or 8 bits. Another preferable application allocates the data on the remaining quantity of black ink to a certain address that is accessed prior to the data on the frequency of attachment of the ink cartridge in the storage element 80 of the black ink cartridge 107K. This arrangement enables the data on the remaining quantity of black ink to be accessed first, for example, in the case of a power-off time discussed later.

The read only data stored in the first storage area 750 include data on the time (year) of unsealing the ink cartridge 107K, data on the time (month) of unsealing the ink cartridge 107K, version data of the ink cartridge 107K, data on the type of ink, for example, a pigment or a dye, data on the year of manufacture of the ink cartridge 107K, data on the month of manufacture of the ink cartridge 107K, data on the date of manufacture of the ink cartridge 107K, data on the production line of the ink cartridge 107K, serial number data of the ink cartridge 107K, and data on the recycle showing whether the ink cartridge 107K is brand-new or recycled, which are respectively allocated to memory divisions 711 through 720 that are accessed in this order.

An intrinsic value is set to the serial number of each ink cartridge 107K, which is accordingly utilized as ID (identification) information. In the case where the data on the year of manufacture, the month of manufacture, the date of manufacture, and the time of manufacture represent the precise time when a certain ink cartridge 107K has been manufactured (for example, to the unit of second even 0.1 second), such data may be utilized as ID information.

Referring to FIG. 9, the memory cell 81 of the storage element 80 incorporated in the color ink cartridge 107F has a first storage area 650, in which read only data are stored, and a second storage area 660, in which rewritable data are stored. The printer main body 100 can only read the data stored in the first storage area 650, while performing both the reading and writing operations with regard to the data stored in the second storage area 660. The second storage area 660 is located at a specific address that is accessed prior to the first storage area 650. Namely the second storage area 660 has a lower address (that is, an address closer to the head) than that of the first storage area 650.

In the second storage area 660, data regarding the frequency of attachment of the ink cartridge is registered in a head portion 600 thereof. First data on the remaining quantity of cyan ink, second data on the remaining quantity of cyan ink, first data on the remaining quantity of magenta ink, second data on the remaining quantity of magenta ink, first data on the remaining quantity of yellow ink, second data on the remaining quantity of yellow ink, first data on the remaining quantity of light cyan ink, second data on the remaining quantity of light cyan ink, first data on the remaining quantity of light magenta ink, and second data on the remaining quantity of light magenta ink are respectively allocated to color ink remaining quantity memory divisions 601 through 610, which follow the head portion 600 and are accessed in this order.

In the same manner as the black ink cartridge 107K, there are the two memory divisions, that is, the first color ink remaining quantity memory division 601 (603, 605, 607, 609) and the second color ink remaining quantity memory division 602 (604, 606, 608, 610), for storing the data on the remaining quantity of each color ink. This arrangement enables the data on the remaining quantity of each color ink to be rewritten alternately in these two memory divisions.

Like the black ink cartridge 107K, both the first and second color ink remaining quantity memory divisions with regard to each color ink in the color ink cartridge 107F have a storage capacity of 1 byte or 8 bits. As discussed above with regard to the storage element 80 of the black ink cartridge 107K, another preferable application allocates the data on the remaining quantities of respective color inks to certain addresses that are accessed prior to the data on the frequency of attachment of the ink cartridge in the storage element 80 of the color ink cartridge 107F. This arrangement enables the data on the remaining quantities of respective color inks to be accessed first, for example, in the case of a power-off time discussed later.

Like the black ink cartridge 107K, the read only data stored in the first storage area 650 include data on the time (year) of unsealing the ink cartridge 107F, data on the time (month) of unsealing the ink cartridge 107F, version data of the ink cartridge 107F, data on the type of ink, data on the year of manufacture of the ink cartridge 107F, data on the month of manufacture of the ink cartridge 107F, data on the date of manufacture of the ink cartridge 107F, data on the production line, serial number data, and data on the recycle that are respectively allocated to memory divisions 611 through 620, which are accessed in this order. These data are common to all the color inks, so that only one set of data are provided and stored as common data to all the color inks. As discussed above with regard to the black ink cartridge 107K, the serial number data may be usable as the ID information.

When the power source 91 of the printer 1 is turned on after the ink cartridges 107K and 107F are attached to the printer main body 100, these data are accessed and utilized by the print controller 40, and may be stored into the EEPROM 90 incorporated in the printer main body 100 as occasions demand. As shown in FIG. 10, memory divisions 801 through 835 in the EEPROM 90 store all the data stored in the respective storage elements 80 including the remaining quantities of the respective inks in the black ink cartridge 107K and the color ink cartridge 107F.

The EEPROM 90 has a plurality of memory divisions, in which the data on the remaining quantity of black ink, the other data relating to the black ink cartridge 107K, the data on the remaining quantities of respective color inks, and the other data relating to the color ink cartridge 107F are stored, as shown in FIG. 10. These data correspond to those stored in the respective storage elements 80 of the black ink cartridge 107K and the color ink cartridge 107F. The difference is that the data on the remaining quantity of each ink has a data length of 32 bits or 4 bytes in the EEPROM 90.

(Operation of Printer 1)

Figure 11:
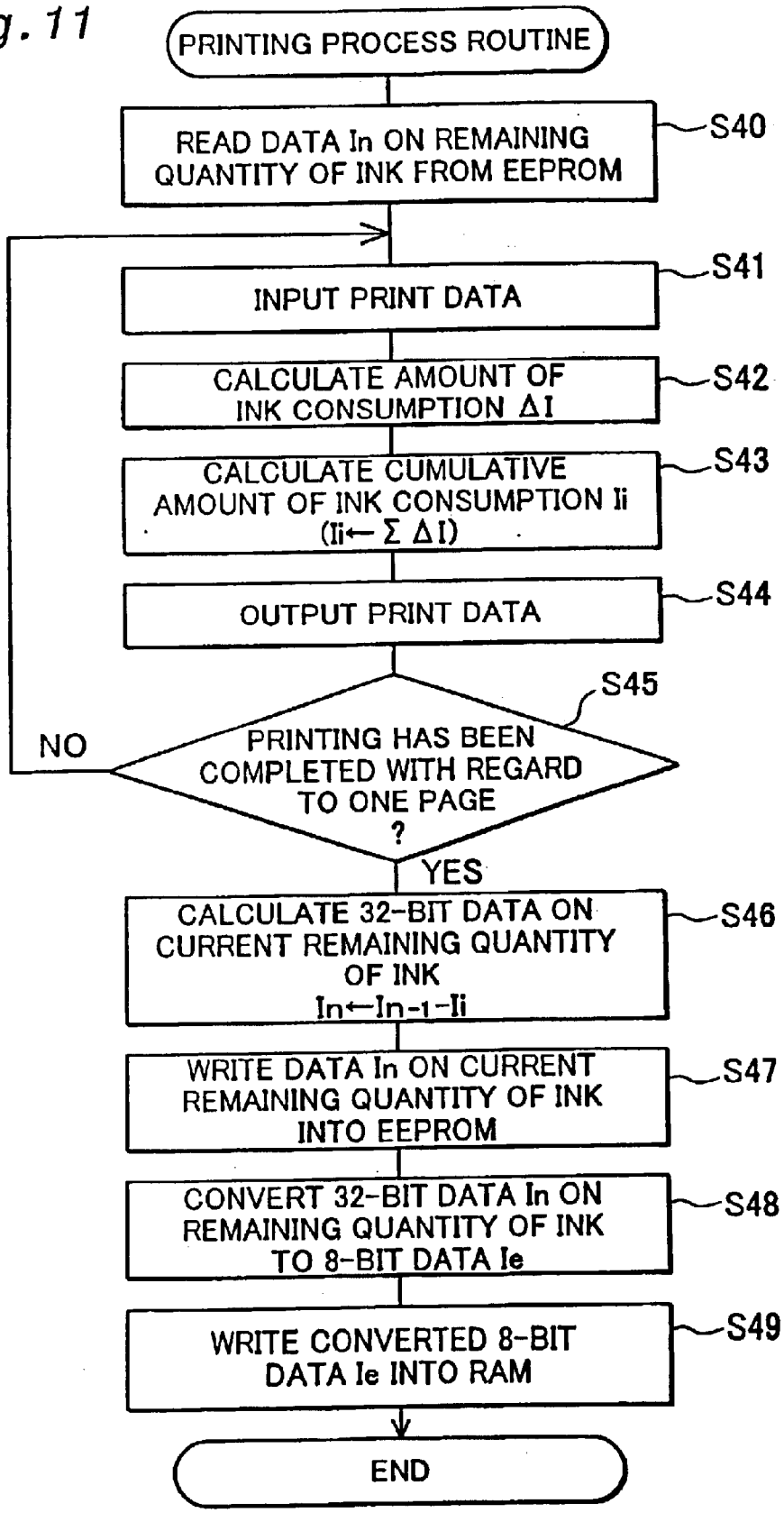
FIG. 11 is a flowchart showing a printing process routine including a process of calculating the remaining quantities of the respective inks.
Figure 12:
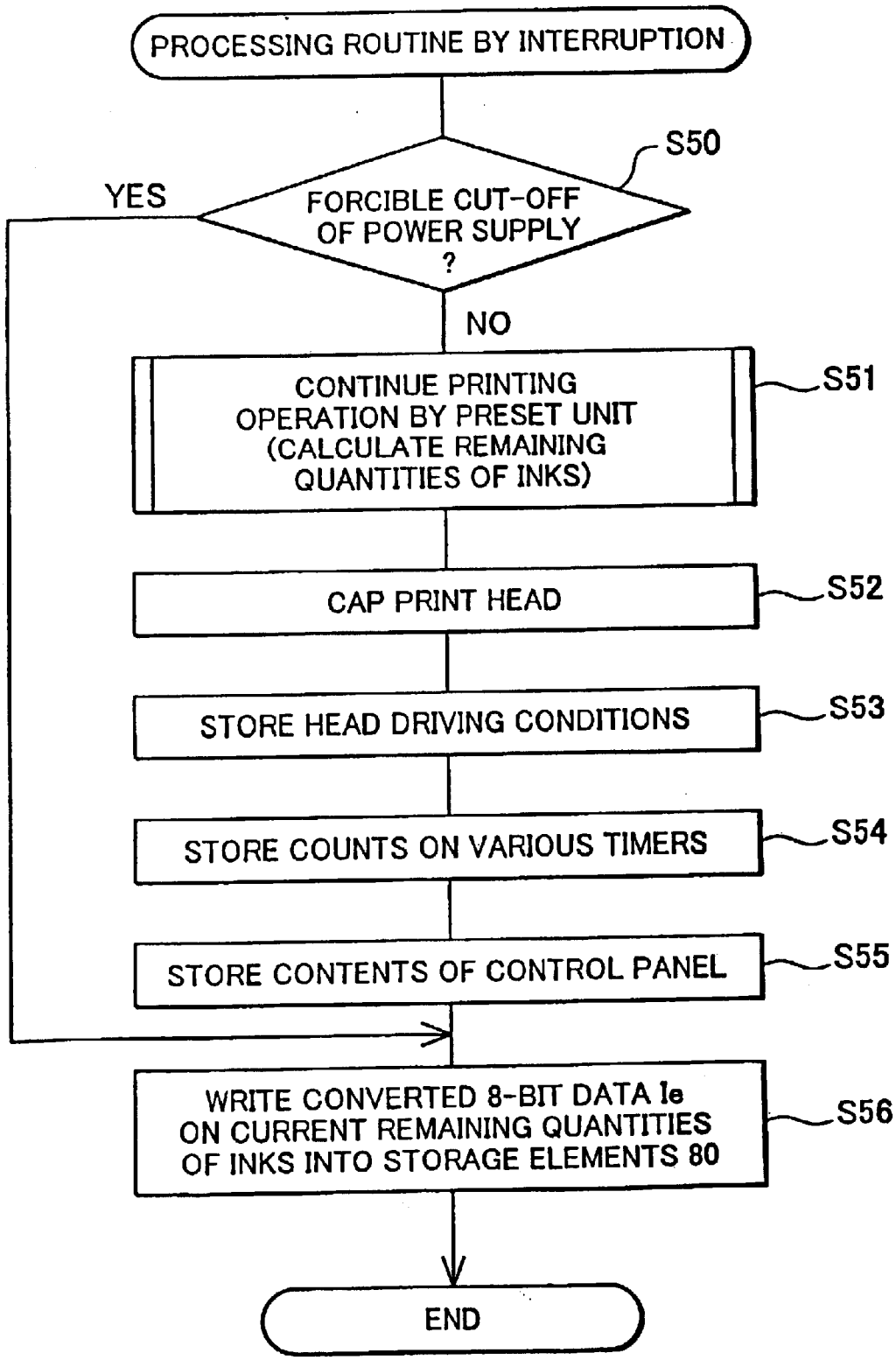
FIG. 12 is a flowchart showing a processing routine to store data into the storage elements 80, which is executed by interruption in response to a power down instruction.
Figure 13:
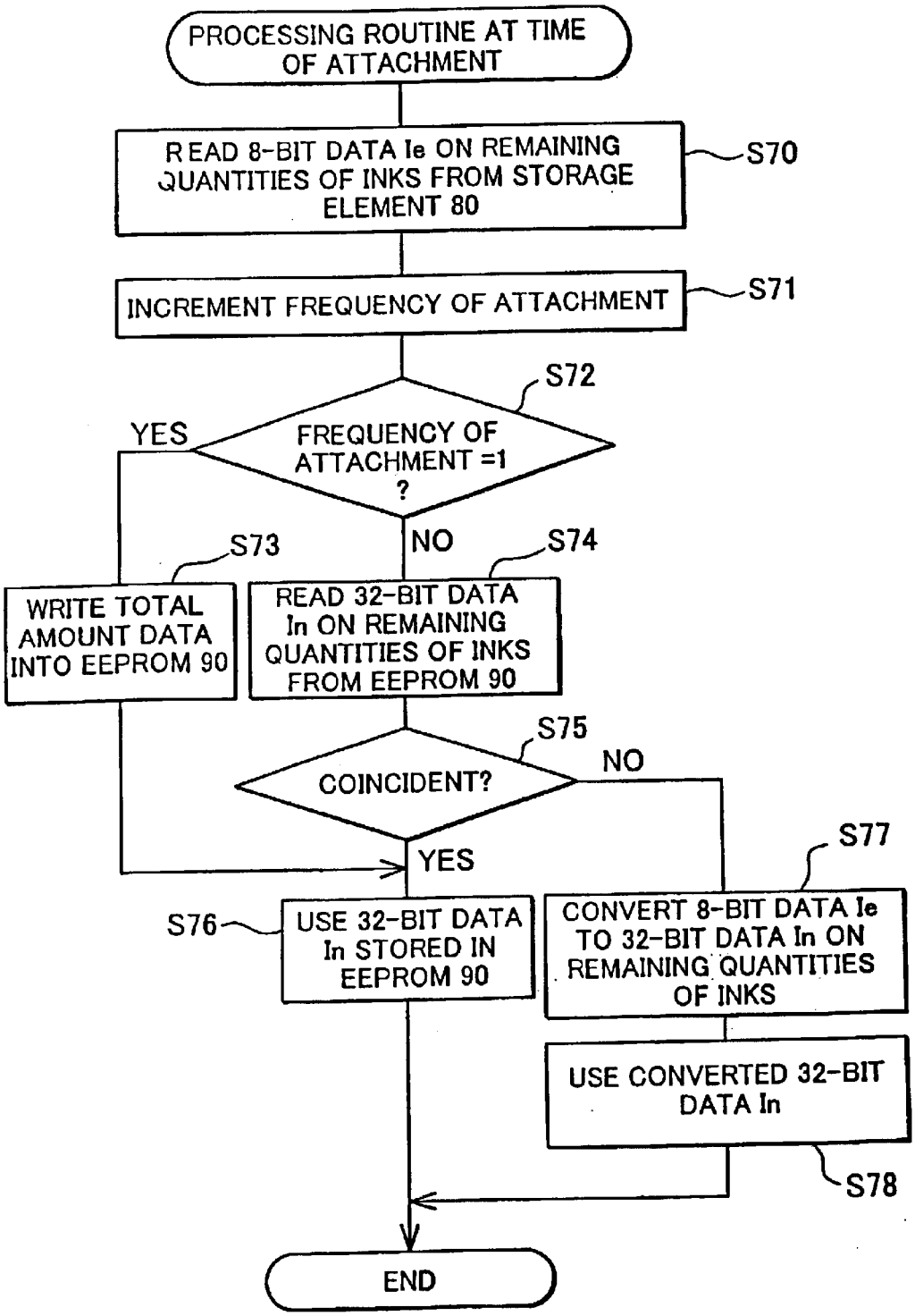
FIG. 13 is a flowchart showing a processing routine executed at a time of attachment of the ink cartridge to the printer 1.

The following describes a series of basic processing carried out by the ink jet printer 1 of the embodiment between a power-on time and a power-off time of the printer 1 and a difference between the allowable frequencies of writing into the storage element 80 and the EEPROM 90, with referring to the flowcharts of FIGS. 11 through 13. FIG. 11 is a flowchart showing a printing process routine including a process of calculating the remaining quantities of the respective inks. FIG. 12 is a flowchart showing a processing routine executed at a power-off time of the printer 1. FIG. 13 is a flowchart showing a processing routine executed when the black and color ink cartridges 107K and 107F are newly attached to the printer 1.

The process of calculating the remaining quantity of each ink is described first. The printer 1 executes the calculation, while carrying out the printing operation in response to a printing instruction sent from the computer PC. More specifically, the controller 46 transfers print data to the print head 10 and simultaneously calculates the remaining quantities of the respective inks. The processing executed in this state is described with reference to the flowchart of FIG. 11. When the program enters the printing process routine shown in FIG. 11, the controller 46 first reads data on the remaining quantity of each ink In from the EEPROM 90 incorporated in the print controller 40 at step S40. The data In is 32-bit data written on completion of the previous cycle of printing operation and represents the latest remaining quantity of each ink. The controller 46 then inputs print data from the computer PC at step S41. In the structure of this embodiment, the required image processing like color conversion and binarization is all carried out in the computer PC, and the printer 1 receives the binary data with regard to a predetermined number of raster lines, that is, the on-off data of ink dots. The controller 46 subsequently calculates an amount of ink consumption ΔI based on the input print data at step S42. The amount of ink consumption ΔI calculated here reflects not only the amount of ink consumption corresponding to the print data with regard to the predetermined number of raster lines input from the computer PC but also the amount of ink consumption by the head cleaning action including the flushing operation and the sucking operation. By way of example, the procedure of calculation multiplies the frequency of ejection of ink droplets by the weight of each ink droplet to calculate the quantity of ink ejection with regard to each ink, and adds the amount of ink consumption by the flushing operation and the sucking operation to the calculated quantity of ink ejection, so as to determine the amount of ink consumption ΔI.

The controller 46 then sums up the amount of ink consumption ΔI thus calculated to determine a cumulative amount of ink consumption Ii at step S43. The amount of ink consumption corresponding to the input print data is successively calculated, but is not written into the EEPROM 90 on every time of calculation. In order to determine the total amount of ink consumption up to the moment, the procedure sums up the amount of ink consumption ΔI with regard to the input print data and thereby determines the cumulative amount of ink consumption Ii. All the data subjected to the calculation are 32-bit data. The controller 46 subsequently converts the input print data to appropriate data suitable for the layout of the nozzle openings 23 on the print head 10 and the ejection timing and outputs the converted print data to the print head 10 at step S44.

When the processing of the input print data with regard to the predetermined number of raster lines is concluded, the controller 46 determines at step S45 whether or not the printing operation has been completed with regard to one page. In the case where the printing operation with regard to one page has not yet been completed, that is, in the case of a negative answer at step S45, the program returns to step S41 and repeats the processing of and after step S41 to input and process a next set of print data. In the case where the printing operation with regard to one page has been completed, that is, in the case of an affirmative answer at step S45, on the other hand, the program calculates the current remaining quantity of each ink In as 32-bit data at S46, and writes the current remaining quantity of ink In thus calculated into the EEPROM 90 at step S47. The current remaining quantity of ink In is obtained by subtracting the cumulative amount of ink consumption Ii determined at step S43 from the previous remaining quantity of ink In−1 read at step S40. The updated remaining quantity of ink In is rewritten into the EEPROM 90.

Figure 14A:
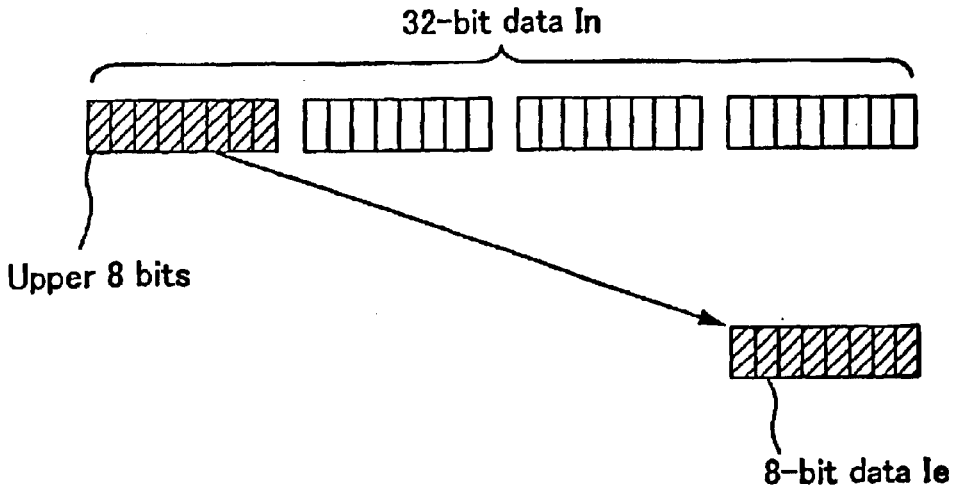
FIGS. 14A and 14B respectively show conversion of 32-bit data to 8-bit data and conversion of 8-bit data to 32-bit data.

The controller 46 then converts the current remaining quantity of ink In calculated as the 32-bit data and written into the EEPROM 90 into an 8-bit value Ie at step S48. The conversion is attained by extracting the upper 8 bits of the 32-bit data as shown in FIG. 14A. This means that the accuracy of data decreases to $1/2^{24}$. The conversion may alternatively be attained by rewriting the original 32-bit data into data representing a percentage in the range of 0 to 100, instead of omitting the lower bits. By way of example, the calculated 32-bit data on the remaining quantity of ink is converted to an 8-bit value of percentage (the integer obtained by omitting the figures below the decimal point or rounding to the nearest whole number) according to Equation (1) given below:

$$Ie = 100 \times \text{Calculated Remaining Quantity of Ink (32 bits)} / \text{Capacity of Ink (32 bits)} \quad (1)$$

The controller 46 subsequently writes the converted 8-bit value Ie into a predetermined area in the RAM 44 at step S49. The converted 8-bit value Ie may be written directly into the storage elements 80 of the ink cartridges 107K and 107F. The technique of this embodiment, however, carries out the writing operation into the respective storage elements 80 of the ink cartridges 107K and 107F only at the timings specified by the processing routine of FIG. 12, by taking into account the relatively low allowable frequency of writing operation of the storage elements 80.

The procedure of this embodiment updates the data on the remaining quantity of ink by the unit of page. This is because the printing operation is generally carried out by the unit of page. One modified procedure carries out the writing operation of data on the remaining quantity of ink with regard to a predetermined number of pages or with regard to one raster line or a predetermined number of raster lines. Another modified procedure determines that the printing operation has been completed every time the print head 10 has moved forward and backward by a predetermined number of times, and writes the data on the remaining quantity of ink into the EEPROM 90.

The updated remaining quantity of each ink In is written as 32-bit data into the EEPROM 90 incorporated in the print controller 40 of the printer 1 at the time of calculation, whereas the converted 8-bit value Ie is written into the RAM 44. The 8-bit data Ie on the remaining quantities of inks stored in the RAM 44 are written into the storage elements 80 of the black ink cartridge 107K and the color ink cartridge 107F when the power down instruction is output. The power down instruction is output at the following three timings as described previously:

(1) at the timing when the power switch 92*a* on the switch panel 92 of the printer 1 is operated to turn the power source 91 off;

(2) at the timing when the cartridge switch 92*b* on the switch panel 92 is operated to give an instruction of replacing the ink cartridge; and (3) at the timing when the power supply is forcibly cut off by pulling the power plug out of the socket.

With referring to the flowchart of FIG. 12, the process of storing the converted 8-bit data In on the remaining quantities of inks into the respective storage elements 80 of the ink cartridges 107K and 107F is described. The processing routine shown in the flowchart of FIG. 12 is activated by interruption in response to the output of the power down instruction as described previously. When the program enters the processing routine of FIG. 12, it is first determined at step S50 whether or not the cause of the interruption is forcible cut-off of the power supply (the timing (3) discussed above). In the case where the cause of the interruption is the forcible cut-off of the power supply, that is, in the case of an affirmative answer at step S50, the allowable access time is very short and thus the program skips the processing of steps S51 through S55 and writes the data on the remaining quantities of inks into the respective storage elements 80 of the ink cartridges 107K and 107F at step S56. The data on the remaining quantities of the respective inks written into the storage elements 80 at step S56 are the 8-bit value Ie calculated by the printing process routine of FIG. 11 and registered in the RAM 44. The technique discussed above with reference to FIGS. 6, 7A, and 7B is applied to write the data on the remaining quantities of inks into the respective storage elements 80 of the ink cartridges 107K and 107F. The data on the remaining quantities of inks are written and stored into the second storage areas 660 and 760 of the respective storage elements 80. Here the remaining quantity of each ink is alternately written into the two memory divisions allocated to the ink. In accordance with one possible application, the execution of the storage into each memory division may be identified by means of a flag, which is located at the head of each memory division and inverted on completion of the writing operation into the memory division.

In the case where the cause of the interruption is not the forcible cut-off of the power supply, that is, in the case of a negative answer at step S50, on the other hand, it is determined that the interruption is caused by either the operation of the power switch 92*a* on the switch panel 92 in the printer 1 to turn the power source 91 off or the operation of the cartridge switch 92*b* on the switch panel 92 to give an instruction of replacement of the ink cartridge. The program accordingly continues the printing operation in progress by a preset unit, for example, up to the end of one raster line, and calculates the remaining quantities of inks at step S51. The calculation is performed according to the flowchart of FIG. 11. The execution of the processing shown in FIG. 11 causes the calculated remaining quantities of the respective inks to be stored as 32-bit data into the EEPROM 90 and as 8-bit data into the RAM 44 as described previously. The controller 46 then drives the capping unit 108 to cap the print head 10 at step S52, and stores the driving conditions of the print head 10 into the EEPROM 90 at step S53. The driving conditions here include a voltage of the driving signal to compensate for the individual difference of the print head and a condition of correction to compensate for the difference between the respective colors. The controller 46 subsequently stores counts on a variety of timers into the EEPROM 90 at step S54, and stores the contents of a control panel, for example, an adjustment value to correct the misalignment of hitting positions in the case of bi-directional printing, into the EEPROM 90 at step S55. After the processing of step S55, the program carries out the processing of step S56 described above. Namely the controller 46 writes the 8-bit data Ie on the remaining quantities of inks, which have been stored in the RAM 44, into the second storage areas 660 and 760 of the respective storage elements 80 of the ink cartridges 107K and 107F at step S56.

In the event that the interruptive processing routine of FIG. 12 is activated by the operation of the switch panel 92, it is determined which switch on the switch panel 92 is operated, after the writing operation of the remaining quantities of inks at step S56. In the case of the power switch 92*a*, a signal is output to the power source 91 to cut off the main power supply to the printer 1. In the case of the cartridge switch 92*b*, on the other hand, the carriage 101 shifts to a specific position for replacement of the ink cartridge. These processes are not specifically shown in the flowchart of FIG. 12.

As described above, every time each ink kept in the ink cartridge 107K or 107F is consumed by the printing operation, the printer 1 of the embodiment calculates the latest remaining quantity of ink and stores the calculated remaining quantity of ink as 32-bit data into the EEPROM 90 of the print controller 40 and as 8-bit data into the RAM 44. When the switch panel 92 is operated to give an instruction of a power-off operation or an instruction of replacing the ink cartridge or when the power supply is forcibly cut off, the 8-bit data Ie on the remaining quantities of inks stored in the RAM 44 are written into the respective storage elements 80 of the black and color ink cartridges 107K and 107F. This arrangement causes the latest remaining quantities of inks to be stored with high accuracy, that is, as 32-bit data, into the EEPROM 90 having a sufficient storage capacity. This arrangement, on the other hand, causes the latest remaining quantities of inks to be stored in a smaller data length, that is, as 8-bit data, into the storage elements 80 of the expendable ink cartridges 107K and 107F, which have relatively small storage capacities. It does not take much time to write the data on the remaining quantities of inks into the respective storage elements 80 of the ink cartridges 107K and 107F. This is especially advantageous for the storage elements 80 of this embodiment that carry out serial access by the unit of each bit. The smaller length of the data written into the storage elements 80 and the shorter time period required for the writing operation into the storage elements 80 are significantly advantageous when the allowable access time is very short, for example, in the case where the power supply is forcibly cut off.

The printer 1 of the embodiment carries out the processing routine shown in the flowchart of FIG. 13 using the 32-bit data In on the remaining quantities of inks stored in the EEPROM 90 of the print controller 40 and the 8-bit data Ie on the remaining quantities of inks stored in the respective storage elements 80 of the ink cartridges 107K and 107F. This facilitates the processing with regard to the remaining quantities of inks in the respective ink cartridges 107K and 107F and enhances the reliability of the processing. FIG. 13 is a flowchart showing a processing routine executed when an ink cartridge is newly attached to the printer 1. More specifically, the processing routine of FIG. 13 is carried out immediately after the carriage 101 shifts to a specific position for replacement of the ink cartridge in response to an operation of the cartridge switch 92*b* on the switch panel 92 and the user implements a replacement of the ink cartridge.

When the program enters the routine of FIG. 13, the controller 46 first reads the 8-bit data Ie on the remaining quantities of inks from the respective storage elements 80 of the black ink cartridge 107K and the color ink cartridge 107F attached to the printer 1 at step S70. The program then proceeds to step S71 to increment the frequency of attachment of each ink cartridge, which is stored in the storage elements 80 of the ink cartridges 107K and 107F, by one. The process of step S71 reads the frequencies of attachment of the respective ink cartridges shown in FIGS. 8 and 9 from certain areas in the storage elements 80, increments the frequencies of attachment, and rewrites the incremented frequencies into the certain areas in the storage elements 80. The frequency of attachment of each ink cartridge has an initial value equal to zero.

The program then determines at step S72 whether or not the frequency of attachment of each ink cartridge is equal to one. In the case where the incremented frequency of attachment is equal to one, it means that the ink cartridge has been attached to the printer 1 for the first time. In this case, total amount data are written as the current remaining quantities of inks into the EEPROM 90 of the print controller 40 at step S73. The total amount data corresponds to the quantity of each ink originally kept in an ink cartridge. In the case where the incremented frequency of attachment is not equal to one, on the other hand, it means that the ink cartridge has already been attached to the printer 1 at least once. The program executes the processing of step S74 and the subsequent steps, in order to determine whether the same ink cartridge, which has just been detached, is attached again to the printer 1 or a different ink cartridge is attached to the printer 1. The controller 46 reads the 32-bit data In on the remaining quantities of inks from the EEPROM 90 of the print controller 40 at step S74. At subsequent step S75, the 32-bit data In on the remaining quantities of inks are converted to 8-bit data and then compared with the 8-bit data Ie on the remaining quantities of inks, which have been read previously from the storage elements 80 of the ink cartridges 107K and 107F. When the upper 8 bits of the 32-bit data In are extracted as the 8-bit data Ie on the remaining quantities of inks at step S48 in the flowchart of FIG. 11, the concrete procedure of step S75 compares the upper 8 bits of the 32-bit data In on the remaining quantities of inks read from the EEPROM 90 with the 8-bit data Ie on the remaining quantities of inks. When the conversion to the 8-bit data Ie is attained by the calculation of values of percentage at step S48 in the flowchart of FIG. 11, on the other hand, the procedure of step S75 converts the 32-bit data In on the remaining quantities of inks read from the EEPROM 90 into values of percentage and carries out the comparison.

Figure 14B:
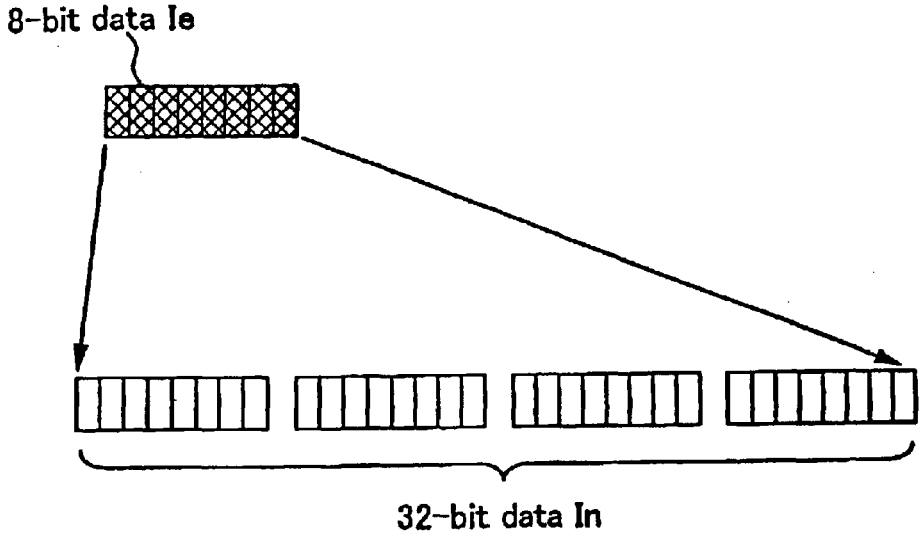

In the event that the converted 8-bit data are coincident with the 8-bit data Ie at step S75, the program determines that the ink cartridge currently attached to the printer 1 is identical with the ink cartridge that has just been detached. In this case, at step S76, it is determined that the 32-bit data In read from the EEPROM 90 can be used as the data on the remaining quantities of inks for the subsequent processing. In the event that the converted 8-bit data are not coincident with the 8-bit data Ie at step S75, on the other hand, the program determines that the 32-bit data In read from the EEPROM 90 can not be used as the data on the remaining quantities of inks and that the data Ie on the remaining quantities of inks read from the storage elements 80 of the ink cartridges 107K and 107F should be used as the data on the remaining quantities of inks for the subsequent processing. The program accordingly converts the 8-bit data Ie on the remaining quantities of inks into the 32-bit data In on the remaining quantities of inks at step S77. The conversion of 8-bit data to 32-bit data executed at step S77 is just reverse to the conversion of 32-bit data to 8-bit data. For example, as shown in FIG. 14B, the 8-bit data Ie are allocated to the upper 8 bits of 32-bit data, whereas the value '0' is allocated to the remaining 24 bits. When the 8-bit data Ie on the remaining quantities of inks represent values of percentage, the conversion of step S77 carries out the reverse calculation according to Equation (1) given above to obtain the 32-bit data In. The program determines that the converted 32-bit data In on the remaining quantities of inks are used for the subsequent calculation of the remaining quantities of inks at step S78 and stores the converted 32-bit data In into a certain area of the EEPROM 90.

As described above, the technique of this embodiment compares the 32-bit data In on the remaining quantities of inks stored in the EEPROM 90 of the printer 1 with the 8-bit data Ie on the remaining quantities of inks stored in the respective storage elements 80 of the ink cartridges 107K and 107F, every time an ink cartridge is newly attached to the printer 1. When the data In and Ie are coincident with each other, the 32-bit data In stored in the EEPROM 90 are used for the subsequent processing. In the case where the same ink cartridge, which has just been detached, is attached again to the printer 1, this arrangement enables the remaining quantity of each ink to be managed with an extremely high accuracy. This accordingly enables the user to be informed of the fact that a certain ink is running out and a replacement of the ink cartridge is required soon or immediately with an extremely high accuracy.

When the 32-bit data In stored in the EEPROM 90 are not coincident with the 8-bit data Ie stored in the storage elements 80, for example, in the case where one ink cartridge has been replaced with another ink cartridge, the 8-bit data Ie on the remaining quantities of inks stored in the storage elements 80 of the ink cartridges 107K and 107F are used for the subsequent processing. Although the accuracy of the 8-bit data Ie is not as high as the accuracy of the 32-bit data In stored in the EEPROM 90, this arrangement enables the consistent management of the remaining quantities of inks even when one ink cartridge has been replaced with another ink cartridge. This accordingly enables the user to be adequately informed of the fact that a certain ink is running out and a replacement of the ink cartridge is required soon or immediately.

In the processing routine of the embodiment, the 32-bit data In on the current remaining quantities of inks are calculated, written into the EEPROM 90, converted to 8-bit data, and written into the RAM 44, every time the printing operation has been completed with regard to one page (see the flowchart of FIG. 11). A modified procedure may carry out the calculation, the conversion, and the writing operation every time the printing operation has been completed with regard to one raster line or a predetermined number of raster lines. Another modified procedure may carry out these processes at different timings. For example, the procedure carries out the calculation of the updated remaining quantities of inks (step S46), the conversion to 8-bit data (step S48), and the storage into the RAM 44 (step S49) every time the printing operation has been completed with regard to one raster line or a predetermined number of raster lines. The procedure, on the other hand, writes the newly calculated remaining quantities of inks into the EEPROM 90 (step S47) every time the printing operation has been completed with regard to one page.

The technique of the embodiment exerts the following effects by making the number of bits in the data Ie on the remaining quantities of inks stored in the storage elements 80 of the ink cartridges 107K and 107F smaller than the number of bits in the data In on the remaining quantities of inks stored in the EEPROM 90 of the printer 1 and differentiating the timings of the writing operations into the EEPROM 90 and the storage elements 80. In the arrangement of the embodiment, data are written into the EEPROM 90 every time the printing operation has been completed with regard to one page. Data are, however, written into the respective storage elements 80 of the ink cartridges 107K and 107F, only (1) when the power switch 92*b* is operated to turn the power source 91 off, (2) when the cartridge switch 92*b* is operated to give an instruction of replacing the ink cartridge, and (3) when the power supply is forcibly cut off. This arrangement causes the data on the remaining quantities of inks to be updated in the EEPROM 90 at a sufficiently high frequency but to be updated in the storage elements 80 at a lower frequency. This restricts the frequency of writing the remaining quantities of inks into the storage elements 80. Since the data having a less number of bits, that is, the 8-bit data, are written into the storage elements 80 at a lower frequency, a storage unit having a lower allowable frequency of writing and a smaller storage capacity may be applied for the storage elements 80 of the expendable ink cartridges 107K and 107F. This further reduces the manufacturing cost of the ink cartridge.

Although the frequency of rewriting data into the storage elements 80 is restricted, the latest data on the remaining quantities of inks are stored as 32-bit data in the EEPROM 90 of the printer 1. The arrangement of the embodiment accordingly does not have any adverse effects on the accuracy of the processing or the monitoring process of the remaining quantities of inks in the printer 1. The monitoring process may blink an LED mounted on the switch panel 92 of the printer 1 when the remaining quantity of ink becomes equal to or less than a preset level. The monitoring process may alternatively inform the printer driver incorporated in the computer PC of the fact that the remaining quantity of ink reaches the preset level and give an alarm on the display MT connected to the computer PC. Since the latest data on the remaining quantities of inks are kept in the EEPROM 90 of the print controller 40, the printer 1 can refer to the latest data on the remaining quantities of inks according to the requirements and output an alarm representing the state of running out of ink at an adequate timing. These data may be utilized to display the current remaining quantities of inks visually, for example, in the form of a bar graph, according to a utility program.

In the first embodiment, the remaining quantities of inks are written into the respective storage elements 80 of the ink cartridges 107K and 107F every time the power down instruction is generated. When there is no change in the remaining quantities of inks, for example, in the case where no printing operation has been carried out since the start of power supply, however, the remaining quantities of inks may not be written into the storage elements 80. Such decision may depend upon a flag, which is set when there is any change in the remaining quantities of inks. In this structure, the value of the flag is read immediately after the output of the power down instruction. In the embodiment discussed above, the data written into the storage elements regard the remaining quantities of inks. There are, however, other data that are written into the EEPROM 90 and the storage elements 80 at different frequencies. By way of example, such data may regard the cumulative time period of use of the ink cartridge or the state of application of the ink cartridge.

The timings of the writing operations into the EEPROM 90 and the storage elements 80 are not restricted to those described above. For example, while the writing operation into the EEPROM 90 is performed M times, the writing operation into the storage elements 80 is performed only once. When the cleaning switch 92*c* on the switch panel 92 is operated to activate the sucking operation, the remaining quantity of ink significantly decreases. The writing operation of data into the storage element 80 may accordingly be carried out on completion of the head cleaning by the sucking action. In accordance with another preferable application, the frequency of writing into the storage element 80 is written into a specific area of the storage element 80. With an increase in frequency of writing, the timing of the writing operation is reduced to decrease the frequency of writing.

In the first embodiment, data on the remaining quantities of inks are stored with regard to the respective inks in the ink cartridges 107K and 107F. This arrangement enables the user to be informed of the remaining quantity of each ink and to receive an alarm representing the state of running out of each ink. In the case of a color ink cartridge with a plurality of different color inks kept therein, for example, the color ink cartridge 107F with five different color inks kept therein, the stored data regard the remaining quantities of the five different color inks. Since the data stored in the ink cartridge are 8-bit data, the required storage capacity is the product of 8 bits and the number of different color inks (5 in this embodiment). This arrangement effectively prevents the required storage capacity of the storage element 80 from being unnecessarily increased. This is especially advantageous in the structure of storing the data on the remaining quantity of each ink in a duplicated manner as the embodiment discussed above.

[Second Embodiment]

Figure 15:
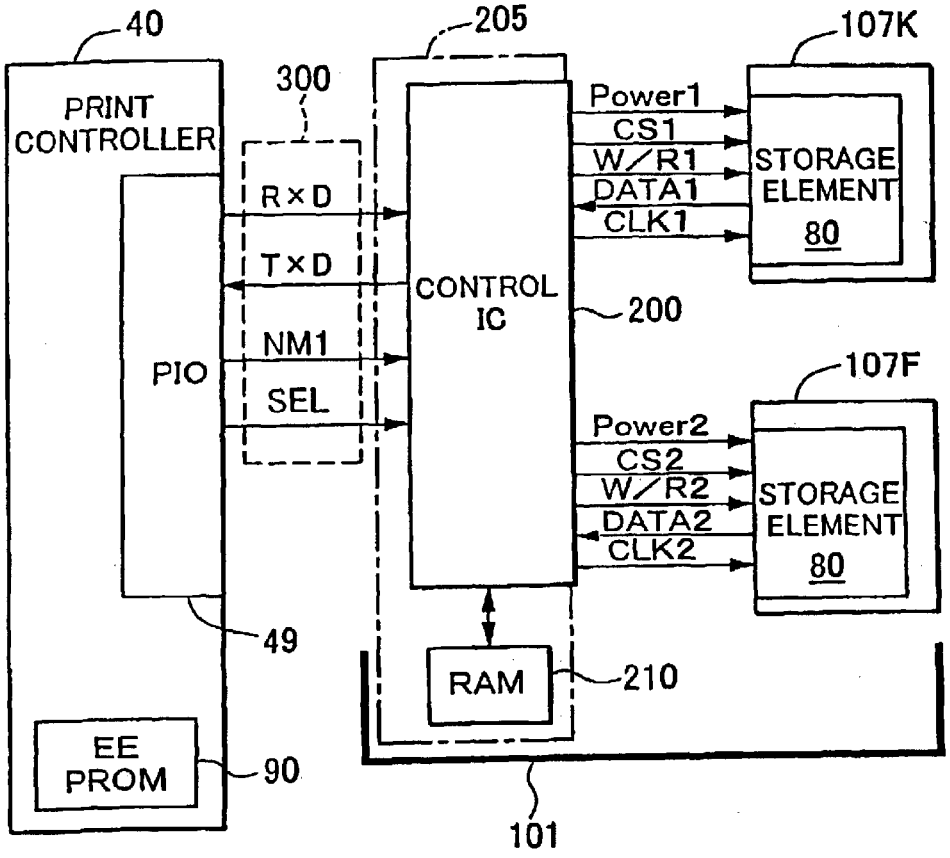
FIG. 15 is a block diagram illustrating a connection of a control IC 200 in a second embodiment according to the present invention.
Figure 16:
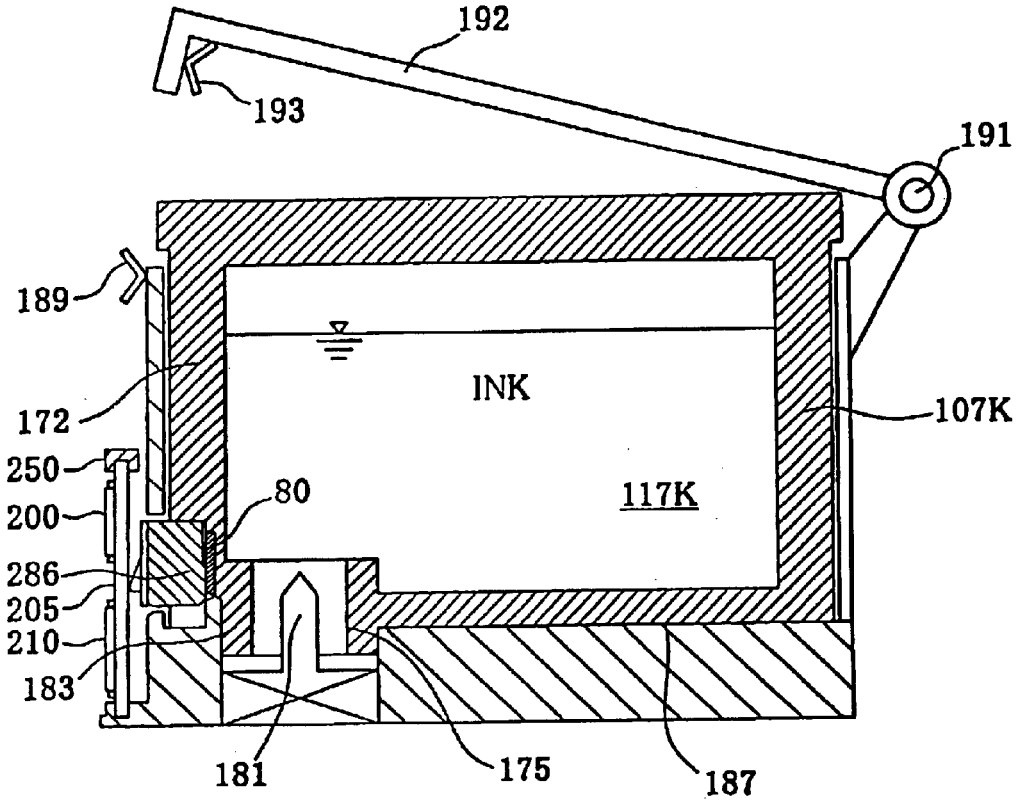
FIG. 16 shows the arrangement of a control board 205 and other related elements in the second embodiment.

The following describes a second embodiment according to the present invention. An ink jet printer and ink cartridges of the second embodiment have structures that are substantially similar to those of the ink jet printer 1 and the ink cartridges 107K and 107F in the first embodiment. The only difference from the first embodiment is that a control IC 200 is provided between the parallel input-output interface 49 in the print controller 40 of the printer 1 and the respective storage elements 80 of the black and color ink cartridges 107K and 107F. Referring to FIG. 15, the control IC 200 is mounted with a RAM 210 on a control board 205. As shown in FIG. 16, the control board 205 is fixed to the cartridge attachment unit 18 on the carriage 101. Data are transmitted between the storage element 80 and the control board 205 via a connector 286. The connector 286 has contact pins on both the side of the storage element 80 and the side of the control board 205. The simple attachment of the control board 205 to an outer fixation element 250 of the cartridge attachment unit 18 thus completes an electrical connection.

The control board 205 is connected with the parallel input-output interface 49 via four signal lines, and data transmission between the control IC 200 and the print controller 40 is implemented by serial communication. The four signal lines include a signal line RxD, through which the control IC 200 receives data, a signal line TxD, through which the control IC 200 outputs data, a power down signal line NMI, through which the print controller 40 outputs a requirement of writing operation at the time of power failure to the control IC 200, and a selection signal line SEL that allows transmission of data through either the signal line RxD or the signal line TxD. These four signals are transmitted between the parallel input-output interface 49 and the control IC 200 via a flexible print cable (FPC) 300. The controller 46 transmits required data to and from the control IC 200 using these four signals. The speed of communication between the controller 46 and the control IC 200 is sufficiently higher than the speed of data transmission between the control IC 200 and the storage elements 80. As described in the first embodiment, the power down signal NMI is output when the power switch 92*a* on the switch panel 92 is operated, when the cartridge switch 92*b* on the switch panel 92 is operated, and when the power supply is forcibly cut off by pulling the power plug out of the socket.

The control IC 200 has a function of separately transmitting data to and from the two storage elements 80. In the arrangement of the second embodiment, one control IC 200 attains data transmission to and from the respective storage elements 80 of the black ink cartridge 107K and the color ink cartridge 107F. In the illustration of FIG. 15, in order to discriminate the signal lines to the respective storage elements 80, a suffix '1' is added to a power source line Power and respective signals CS, R/W, I/O, and CLK (see FIG. 6) with regard to the black ink cartridge 107K and a suffix '2' is added with regard to the color ink cartridge 107F.

In the structure of the second embodiment, the controller 46 of the print controller 40 in the printer 1 writes the data on the quantities of the respective inks not only into the EEPROM 90 but into the RAM 210 mounted on the control board 205. The controller 46 makes the selection signal SEL active to select the control IC 200 and writes the current data In on the quantities of inks into the control IC 200 through the signal line RxD by non-synchronous serial communication.

In the case of a press of the power switch 92*a*. A press of the cartridge switch 92*b*, or the forcible cut-off of the power supply, the print controller 40 outputs the power down signal NMI both inside the print controller 40 and outside the print controller 40, that is, to the control IC 200. The control IC 200 receives the power down signal NMI and writes at least the data regarding the quantities of the respective inks among the data stored in the RAM 210, into the respective storage elements 80 of the ink cartridges 107K and 107F. The control IC 200 carries out the writing operation in the storage elements 80 by the technique discussed in the first embodiment. As shown in FIGS. 7A and 7B, the technique first makes the chip select signal CS active, then makes the read/right signal R/W in the high active state to select the writing operation, and successively outputs the data DATA synchronously with the clock signal CLK.

In the structure of the second embodiment, the controller 46 of the print controller 40 in the printer 1 carries out the processing routine shown in the flowchart of FIG. 12. In the second embodiment, however, after calculating the current remaining quantities of inks In+1 at step S46, the controller 46 writes the calculated current remaining quantities of inks In+1 not into the EEPROM 90 but into the RAM 210 incorporated in the control IC 200. The controller 46 makes the selection signal SEL active to select the control IC 200 and writes the current data In+1 on the remaining quantities of inks into the control IC 200 through the signal line RxD by non-synchronous serial communication.

Figure 17:
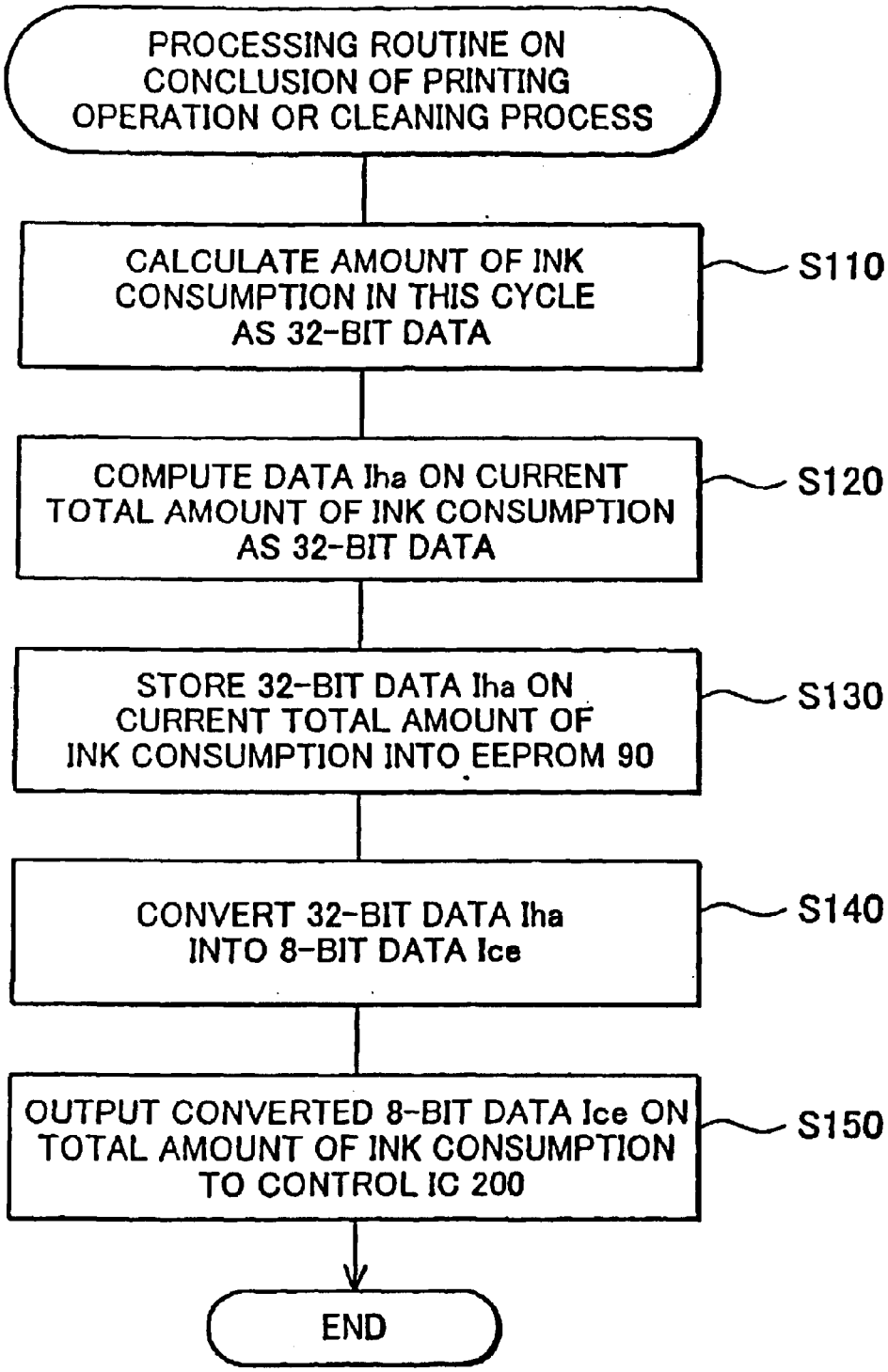
FIG. 17 is a flowchart showing a processing routine executed on the completion of a printing operation or a cleaning process in the second embodiment.

The following describes the processing with regard to the quantity of each ink kept in the ink cartridge, which is carried out in the second embodiment. The arrangement of the second embodiment uses the 'amount of ink consumption' in place of the 'remaining quantity of ink' for the processing with regard to the quantity of ink kept in the ink cartridge. The processing may, however, be carried out with respect to the remaining quantity of ink, like the first embodiment. FIG. 17 is a flowchart showing a processing routine executed by the controller 46 of the print controller 40 in the second embodiment. The processing routine of FIG. 17 is carried out at the time of execution of one of the specific processes that vary the amount of ink consumption in the ink cartridge, for example, the printing operation or the cleaning process. This processing is applicable to the case of an increase in quantity of ink as well as to the case of a decrease in quantity of ink. By way of example, in a structure that allows the ink cartridge to be refilled with ink, the processing routine is carried out at the time of refilling the ink cartridge.

When the program enters the processing routine of FIG. 17, the controller 46 first calculates the amount of consumption of each ink by the printing operation and the cleaning process in this cycle as 32-bit data at step S110. At subsequent step S120, current data Iha on the total amount of consumption of each ink is computed as 32-bit data by subtracting the calculated amount of consumption of each ink in this cycle from the previous data on the total amount of consumption of each ink stored in the EEPROM 90. The controller 46 then writes the computed current data Tha on the totals amounts of consumption of the respective inks into the EEPROM 90 at step S130. This processing causes the latest data Iha on the total amounts of consumption of the respective inks to be stored in the EEPROM 90 of the print controller 40.

The current 32-bit data Iha on the total amounts of consumption of the respective inks are then converted to 8-bit data Ice on the total amounts of consumption of the respective inks at step S140. One of the techniques described in the first embodiment is applied for the conversion to the 8-bit data executed at step S140. The controller 46 subsequently outputs the converted 8-bit data Ice on the total amounts of consumption of the respective inks to the control IC 200 at step S150. The output 8-bit data Ice are to be written into the storage elements 80 of the ink cartridges 107K and 107F.

In the processing of the second embodiment discussed above, the data on the total amounts of consumption of the respective inks, which are to be written into the storage elements 80 of the ink cartridges 107K and 107F, are stored in the RAM 210 on the control board 205 via the control IC 200 that directly controls the data transmission to and from the storage elements 80. The controller 46 writes the data regarding the quantities of inks into the RAM 210 via the control IC 200 every time the data on the total amounts of consumption of the respective inks are updated. Namely the latest data on the total amounts of consumption of the respective inks are registered in the RAM 210 on the control board 205. When the power down signal NMI is output in response to the forcible cut-off of the power supply, the data stored in the RAM 210 are immediately written into the respective storage elements 80 of the ink cartridges 107K and 107F, irrespective of the operations of the print controller 40 and the controller 46 therein. This arrangement desirably simplifies the processing of the controller 46 at the time of forcible cut-off of the power supply and thereby significantly reduces the loading of the processing.

Figure 18:
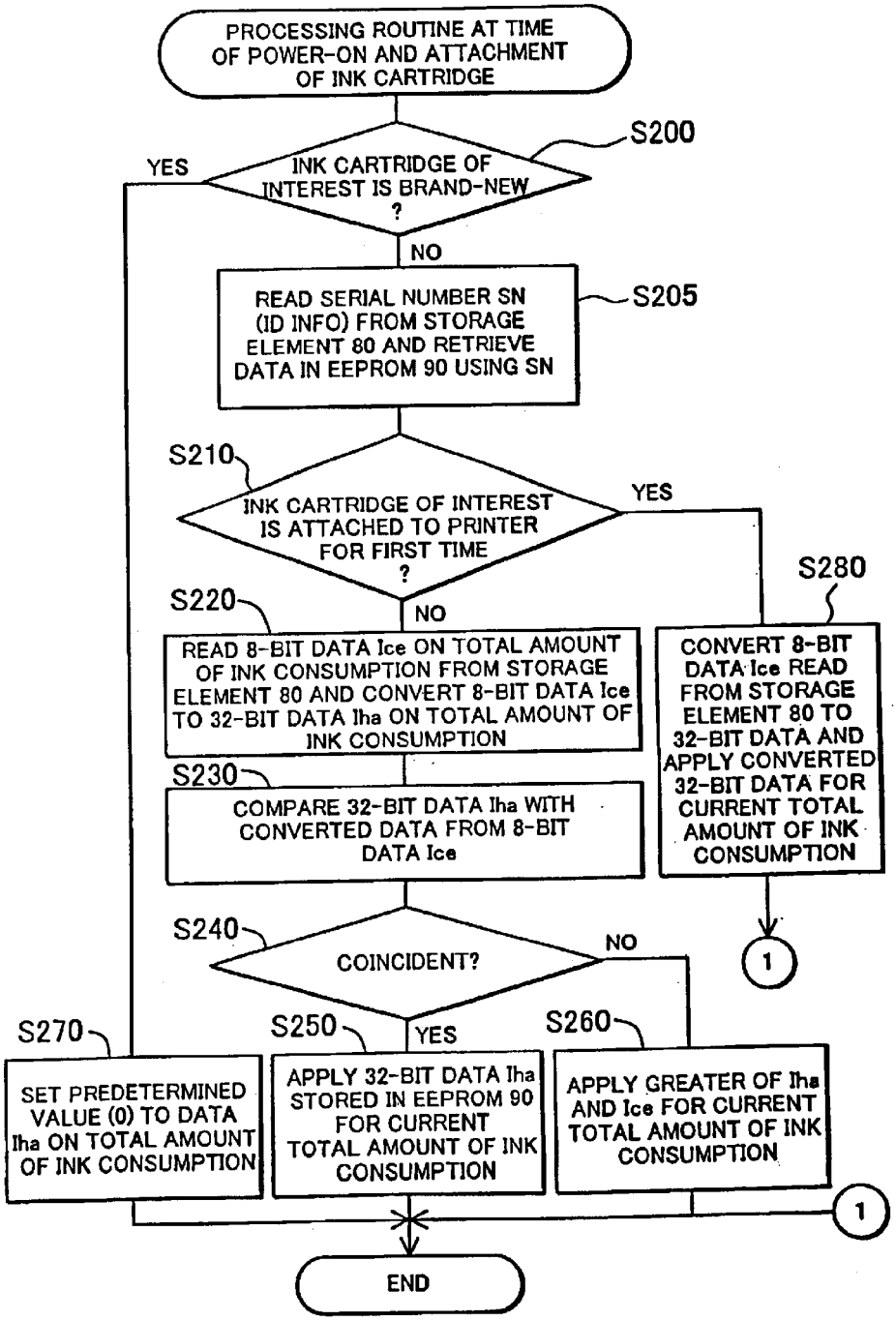
FIG. 18 is a flowchart showing a processing routine executed at the time of a power-on operation and at the time of attachment of the ink cartridge to the printer 1.

The following describes the processing carried out when the power source 91 is turned on or when the ink cartridge is replaced with a new one. FIG. 18 is a flowchart showing a processing routine executed at the time of a power-on operation and at the time of attachment of the ink cartridge to the printer 1. When the program enters the routine of FIG. 18, it is determined at step S200 whether or not the ink cartridge of interest currently attached to the printer 1 is brand-new, based on the frequency of attachment. In the case where the brand-new ink cartridge is attached to the printer 1, a predetermined value is set to the data Iha on the total amount of consumption of each ink, which is used for the subsequent processing, at step S270. The predetermined value is generally equal to zero. In the case of a half-sized ink cartridge where quantities of inks kept therein are half the quantities of inks kept in a standard-sized ink cartridge, a specific value corresponding to half the potential total amount of ink consumption with regard to the standard-sized ink cartridge may be set to the data Iha. Information regarding the type of the ink cartridge 107K or 107F attached to the printer 1, for example, a half-sized ink cartridge or a free ink cartridge with less quantities of inks kept therein, which is packaged with the printer 1 on delivery, may be written directly in the storage element 80 of the ink cartridge 107K or 107F. The upper two figures of a serial number may alternatively be used for the identification of the type of the ink cartridge.

When it is determined at step S200 that the ink cartridge of interest 107K or 107F currently attached to the printer 1 is not brand-new, based on the frequency of attachment, the controller 46 reads a serial number SN as the identification information from the storage element 80 of the ink cartridge 107K or 107F and retrieves the data stored in the EEPROM 90 using the serial number SN at step S205. The process of retrieval refers to a table that provides the serial numbers SN as indexes as shown in FIG. 19 and is stored in the EEPROM 90. The serial number SN of the ink cartridge attached to the printer 1 at least once has been written corresponding to the total quantity of consumption of each ink in the EEPROM 90, in the allowable range of storage capacity. As the storage capacity of the EEPROM 90 is fully occupied, the older data are deleted sequentially.

It is determined at step S210 whether or not the ink cartridge of interest is attached to the printer 1 for the first time by referring to the table. In the case where the serial number SN read from the storage element 80 of the ink cartridge of interest 107K or 107F is found in the table stored in the EEPROM 90, the program determines at step S210 that it is not the first time when the ink cartridge of interest is attached to the printer 1. In this case, the 8-bit data Ice on the total amounts of consumption of the respective inks are read from the storage element 80 of the ink cartridge 107K or 107F and converted to 32-bit data Iha on the total amounts of consumption of the respective inks at step S220. The 32-bit data Iha on the total amounts of consumption of the respective inks read from the EEPROM 90 are subsequently compared with the converted 32-bit data Iha on the total amounts of consumption of the respective inks, which are calculated from the 8-bit data Ice stored in the storage element 80, at step S230. It is then determined at step S240 whether or not the original 32-bit data are coincident with the converted 32-bit data.

When the result of the comparison determines that the original 32-bit data are coincident with the converted 32-bit data at step S240, the program determines that the same ink cartridge is used continuously or the same ink cartridge, which has been detached once, is attached again to the printer 1. In this case, the 32-bit data Iha on the total amounts of consumption of the respective inks stored in the EEPROM 90 are used as the current total amounts of consumption of the respective inks at step S250. When the result of the comparison determines that the original 32-bit data are not coincident with the converted 32-bit data at step S240, on the other hand, the greater of the original 32-bit data Iha on the total amounts of consumption of the respective inks stored in the EEPROM 90 and the converted 32-bit data Iha from the 8-bit data Ice are used as the current total amounts of consumption of the respective inks at step S260. The process of step S260 does not unequivocally apply the data stored in the storage element 80 of the ink cartridge 107K or 107F, since the ink cartridge attached to the printer 1 has been specified in advance using the serial number SN as the identification information. This arrangement takes into account a possible error in conversion and adopts the greater of the original data and the converted data, both regarding the total amounts of consumption of the respective inks. One possible modification preferentially adopts the data on the total amounts of consumption of the respective inks stored in the storage elements 80 of the ink cartridges 107K and 107F. For example, in a structure that allows the ink cartridge to be refilled with ink using a special ink filler and rewrites the total amounts of consumption of the respective inks in response to each refilling operation, the information stored in the storage elements 80 of the ink-cartridges 107K and 107F are used preferentially.

When it is determined at step S210 that the ink cartridge of interest 107K or 107F, which is not brand-new, is attached to the printer 1 for the first time, by referring to the table shown in FIG. 19, it means that the ink cartridge has been used for another printer. In this case, at step S280, the 8-bit data Ice on the total amounts of consumption of the respective inks are read from the storage element 80 of the ink cartridge 107K or 107F and converted to the 32-bit data, which are used as the total amounts of consumption of the respective inks for the subsequent processing.

Like the arrangement of the first embodiment, the arrangement of the second embodiment advantageously reduces the lengths of data stored in the storage elements 80 of the ink cartridges 107K and 107F. The ink cartridge attached to the printer 1 is specified by the identification information. In the case where a plurality of different ink cartridges are successively attached to the printer 1 and used for printing, this arrangement ensures the precise identification of each ink cartridge and enables the total amounts of consumption of the respective inks in the ink cartridge that is attached again to the printer 1 without being used for another printer to be managed with a significantly higher accuracy, compared with the accuracy of the data stored in the storage element of the ink cartridge. Even in the case where the ink cartridge is attached again to the printer 1 after being used for another printer, the total amounts of consumption of the respective inks can be managed with a fair level of accuracy.

The present invention is not restricted to the above embodiments or their modifications, but there may be many other modifications, changes, and alterations without departing from the scope or spirit of the main characteristics of the present invention. For example, dielectric memories (FROM) may replace the memory cells 81 in the storage elements 80 and the EEPROM 90.

Figure 20:
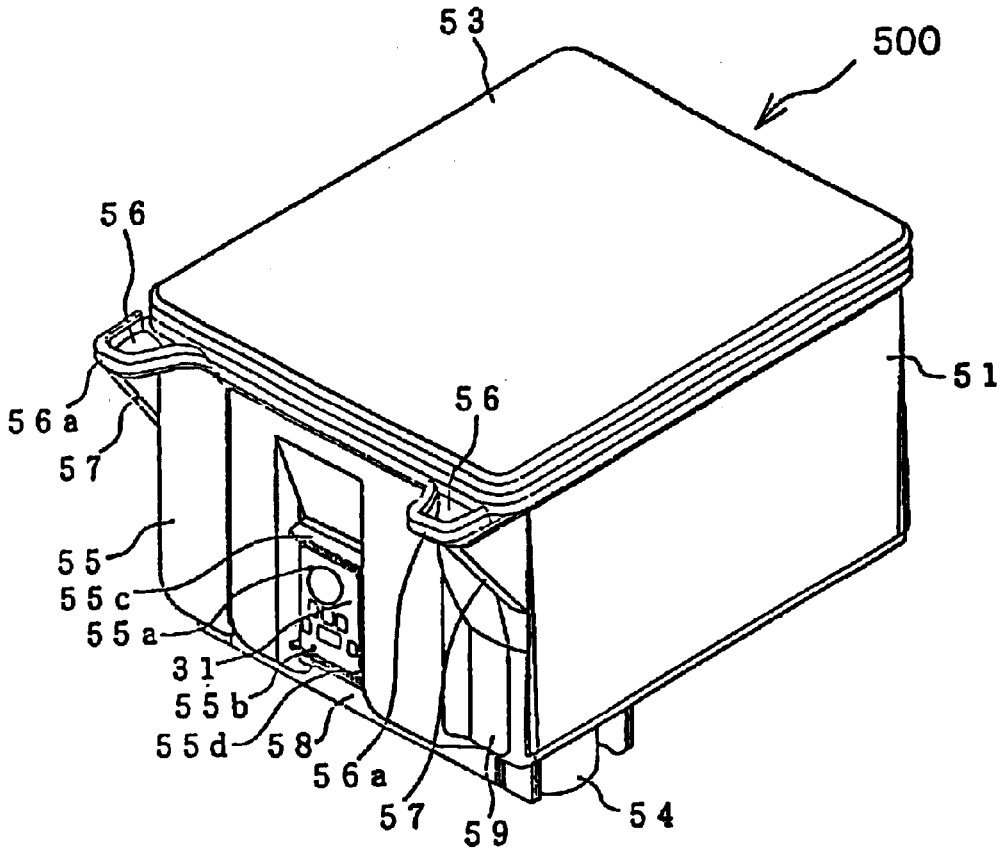
FIG. 20 is a perspective view illustrating the structure of another color ink cartridge as one modification of the present invention.

The storage elements 80 may not be incorporated in the respective ink cartridges 107K and 107F, but may be exposed to the outside. FIG. 20 shows a color ink cartridge 500 having an exposed storage element. The ink cartridge 500 includes a vessel 51 substantially formed in the shape of a rectangular parallelepiped, a porous body (not shown) that is impregnated with ink and accommodated in the vessel 51, and a cover member 53 that covers the top opening of the vessel 51. The vessel 51 is parted into five ink chambers (like the ink chambers 107C, 107LC, 107M, 107LM, and 107Y in the ink cartridge 107F discussed in the above embodiments), which separately keep five different color inks. Ink supply inlets 54 for the respective color inks are formed at specific positions on the bottom face of the vessel 51. The ink supply inlets 54 at the specific positions face ink supply needles (not shown here) when the ink cartridge 500 is attached to a cartridge attachment unit of a printer main body (not shown here). A pair of extensions 56 are integrally formed with the upper end of an upright wall 55, which is located on the side of the ink supply inlets 54. The extensions 56 receive projections of a lever (not shown here) fixed to the printer main body. The extensions 56 are located on both side ends of the upright wall 55 and respectively have ribs 56*a*. A triangular rib 57 is also formed between the lower face of each extension 56 and the upright wall 55. The vessel 51 also has a check recess 59, which prevents the ink cartridge 500 from being attached to the unsuitable cartridge attachment unit mistakenly.

The upright wall 55 also has a recess 58 that is located on the substantial center of the width of the ink cartridge 500. A circuit board 31 is mounted on the recess 58. The circuit board 31 has a plurality of contacts, which are located to face contacts on the printer main body, and a storage element (not shown) mounted on the rear face thereof. The upright wall 55 is further provided with projections 55*a* and 55*b* and extensions 55*c* and 55*d* for positioning the circuit board 31.

Like the embodiments discussed above, the ink cartridge 500 of this modified structure also enables the required data, such as the data on the remaining quantities of inks, to be stored into the storage element provided on the circuit board 31. The data stored in the storage element of the ink cartridge 500 has a shorter bit length than that of the data stored in the EEPROM incorporated in the printer main body.

The above embodiments apply the five color inks, that is, magenta, cyan, yellow, light cyan, and light magenta, for the plurality of color inks kept in the color ink cartridge. The principle of the present invention is, however, also applicable to another ink cartridge, in which any combination of an arbitrary number of different inks, for example, six or seven different color inks, are kept. The present invention is further applicable to the structure in which the ink cartridges are set in the printer main body, as well as to the structure in which the ink cartridges are mounted on the carriage.

The scope and spirit of the present invention are limited only by the terms of the appended claims.

What is claimed is:

1. A cartridge for containing ink therein, and which can be detachably mounted on an ink-jet printer having a memory that stores information, in a printer format, corresponding to an amount of ink in said cartridge, comprising:

a cartridge body; and a rewritable non-volatile memory mounted on the cartridge body and storing data, in an ink cartridge format, corresponding to at least one of a remaining amount of ink contained in said cartridge and an ink consumption, said ink cartridge format being different from the printer format.

2. A cartridge as in claim 1, wherein said ink cartridge format is more compact than the printer format.

3. A cartridge as in claim 2, wherein said ink cartridge format is 8-bit data and the printer format is 32-bit data.

4. A cartridge as in claim 1, wherein said non-volatile memory is an EEPROM.

5. A cartridge as in claim 1, further comprising:

an output signal path electrically communicating with said non-volatile memory for outputting of said data from said non-volatile memory by serial access; and an input signal path electrically communicating with said non-volatile memory so that the non-volatile memory can receive signals derived from the information, in the printer format, corresponding to the amount of ink in said cartridge, wherein said non-volatile memory writes the received signals in synchronism with a clock for specifying an address.

6. A cartridge as in claim 1, wherein said ink cartridge format has a number of bits that is smaller than a number of bits in the printer format and said data in said ink cartridge format includes some of the bits from the corresponding information in the printer format.

7. A cartridge as in claim 6, wherein said data in said ink cartridge format include some bits from a higher portion, and not some bits from a lower portion, of the corresponding information in the printer format.

8. A cartridge as in claim 1, wherein said data in said ink cartridge format is obtained by extracting an upper 8 bits of the information in the printer format.

9. A cartridge as in claim 1, wherein the data in said ink cartridge format written into said non-volatile memory is obtained by converting the information in the printer format to data representing a percentage.

10. A cartridge as in claim 1, said cartridge further comprising:

an ink reservoir, in which a plurality of different inks are kept, contained in the cartridge body;

wherein said data in said ink cartridge format in said non-volatile memory includes information regarding each of the plurality of different inks.

11. A cartridge as in claim 10, wherein said ink reservoir is divided into at least three ink chambers, in which at least three different inks are respectively kept, and wherein said non-volatile memory has a plurality of information storage areas, said information areas respectively and independently storing said information regarding each of said plurality of inks, said information regarding each of said plurality of inks including information corresponding to a quantity of each of said at least three different inks, wherein said information storage areas each have a total storage capacity that is not greater than 2 bytes.

12. A cartridge as in claim 10, wherein said ink reservoir is divided into at least five ink chambers, in which at least five different inks are kept, and said non-volatile memory has a plurality of information storage areas, said information areas respectively and independently storing said information regarding each of said at least five different inks, and wherein said information storage areas each have a total storage capacity that is not greater than 2 bytes.

* * * * *